US009717979B2

(12) United States Patent
Grauzer et al.

(10) Patent No.: US 9,717,979 B2
(45) **Date of Patent: *Aug. 1, 2017**

(54) CARD HANDLING DEVICES AND RELATED METHODS

(75) Inventors: Attila Grauzer, Las Vegas, UT (US); Ernst Blaha, Tullnerbach (AT); Peter Krenn, Neufeld (AT); Paul K. Scheper, Eden Prairie, MN (US)

(73) Assignee: BALLY GAMING, INC., Las Vegas, NV (US)

( * ) Notice: Subject to any disclaimer, the term of this patent is extended or adjusted under 35 U.S.C. 154(b) by 658 days.

This patent is subject to a terminal disclaimer.

(21) Appl. No.: 13/431,757

(22) Filed: Mar. 27, 2012

(65) Prior Publication Data

US 2012/0181747 A1 Jul. 19, 2012

Related U.S. Application Data

(63) Continuation of application No. 12/848,631, filed on Aug. 2, 2010, now Pat. No. 8,141,875, which is a (Continued)

(51) Int. Cl.
*A63F 1/12* (2006.01)
*A63F 1/14* (2006.01)

(52) U.S. Cl.
CPC . *A63F 1/12* (2013.01); *A63F 1/14* (2013.01)

(58) Field of Classification Search
USPC ..... 273/149 R, 149 P
See application file for complete search history.

(56) References Cited

U.S. PATENT DOCUMENTS

| | | | |
|---|---|---|---|
| 793,489 | A | 6/1905 | Williams |
| 1,014,219 | A | 1/1912 | Hall |

(Continued)

FOREIGN PATENT DOCUMENTS

| | | |
|---|---|---|
| WO | 8700764 | 2/1987 |
| WO | 9840136 | 9/1998 |
| WO | 0051076 | 8/2000 |

OTHER PUBLICATIONS

CD Labeled "Shuffler Art". Attached to this 1449 is a spreadsheet having the names of the individual files within the CD. There is a self-executing function on the CD so that, upon entering the Spreadsheet Table of Contents (Index), individual items may be opened directly from the spreadsheet according to the title of the document (2003).

(Continued)

*Primary Examiner* — William Pierce
(74) *Attorney, Agent, or Firm* — TraskBritt

(57) ABSTRACT

Card handling devices comprise a card handling zone. A card infeed tray is configured to pass cards to the card handling zone and a separate card output tray is configured to receive cards from the card handling zone. A control system of the card handling device comprises at least one electronic signal processor, at least one memory device in electrical communication with the electronic signal processor, and a computer program stored in the memory of the memory device. The computer program is programmed to cause the control system to selectively control at least one of a card infeed system, the card handling zone, and a card output system of the card handling device and to receive an input from a user input to selectively perform at least one of a shuffling operation, a sorting operation, and a dealing operation using the card handling device.

20 Claims, 9 Drawing Sheets

Related U.S. Application Data continuation of application No. 11/598,259, filed on Nov. 9, 2006, now Pat. No. 7,766,332, which is a continuation-in-part of application No. 11/481,407, filed on Jul. 5, 2006, now Pat. No. 8,342,525.

(56) References Cited

U.S. PATENT DOCUMENTS

| | | | |
|---|---|---|---|
| 1,885,276 | A | 11/1932 | McKay |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,065,824 | A | 12/1936 | Plass |
| 2,254,484 | A | 9/1941 | Hutchins |
| 2,328,153 | A | 8/1943 | Laing |
| 2,328,879 | A | 9/1943 | Isaacson |
| 2,364,413 | A | 12/1944 | Wittel |
| 2,778,644 | A | 1/1957 | Stephenson |
| 2,937,739 | A | 5/1960 | Levy |
| 2,950,005 | A | 8/1960 | MacDonald |
| 3,147,978 | A | 9/1964 | Sjostrand |
| 3,235,741 | A | 2/1966 | Plaisance |
| 3,312,473 | A | 4/1967 | Friedman et al. |
| 3,530,968 | A | 9/1970 | Palmer |
| 3,595,388 | A | 7/1971 | Castaldi |
| 3,690,670 | A | 9/1972 | Cassady |
| 3,716,238 | A | 2/1973 | Porter |
| 3,897,954 | A | 8/1975 | Erickson |
| 3,944,230 | A | 3/1976 | Fineman |
| 4,159,581 | A | 7/1979 | Lichtenberg |
| 4,232,861 | A | 11/1980 | Maul |
| 4,310,160 | A | 1/1982 | Willette |
| 4,361,393 | A | 11/1982 | Noto |
| 4,368,972 | A | 1/1983 | Naramore |
| 4,385,827 | A | 5/1983 | Naramore |
| 4,388,994 | A | 6/1983 | Suda et al. |
| 4,397,469 | A | 8/1983 | Carter, III |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,534,562 | A | 8/1985 | Cuff et al. |
| 4,566,782 | A | 1/1986 | Britt et al. |
| 4,586,712 | A | 5/1986 | Lorber et al. |
| 4,659,082 | A | 4/1987 | Greenberg |
| 4,662,637 | A | 5/1987 | Pfeiffer |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,876,000 | A | 10/1989 | Mikhail et al. |
| 4,900,009 | A | 2/1990 | Kitahara et al. |
| 4,926,327 | A | 5/1990 | Sidley |
| 4,951,950 | A | 8/1990 | Normand et al. |
| 4,969,648 | A | 11/1990 | Hollinger et al. |
| 4,995,615 | A | 2/1991 | Cheng |
| 5,000,453 | A | 3/1991 | Stevens et al. |
| 5,067,713 | A | 11/1991 | Soules et al. |
| 5,081,487 | A | 1/1992 | Hoyer et al. |
| 5,121,192 | A | 6/1992 | Kazui |
| 5,121,921 | A | 6/1992 | Friedman et al. |
| 5,179,517 | A | 1/1993 | Sarbin et al. |
| 5,199,710 | A | 4/1993 | Lamle |
| 5,209,476 | A | 5/1993 | Eiba |
| 5,224,712 | A | 7/1993 | Laughlin et al. |
| 5,240,140 | A | 8/1993 | Huen |
| 5,257,179 | A | 10/1993 | De Mar |
| 5,261,667 | A | 11/1993 | Breeding |
| 5,275,411 | A | 1/1994 | Breeding |
| 5,276,312 | A | 1/1994 | McCarthy |
| 5,283,422 | A | 2/1994 | Storch et al. |
| 5,288,081 | A | 2/1994 | Breeding |
| 5,299,089 | A | 3/1994 | Lwee |
| 5,303,921 | A | 4/1994 | Breeding |
| 5,356,145 | A | 10/1994 | Verschoor |
| 5,362,053 | A | 11/1994 | Miller |
| 5,374,061 | A | 12/1994 | Albrecht |
| 5,382,024 | A | 1/1995 | Blaha |
| 5,382,025 | A | 1/1995 | Sklansky et al. |
| 5,390,910 | A | 2/1995 | Mandel et al. |
| 5,431,399 | A | 7/1995 | Kelley |
| 5,437,462 | A | 8/1995 | Breeding |
| 5,445,377 | A | 8/1995 | Steinbach |
| 5,470,079 | A | 11/1995 | LeStrange et al. |
| 5,524,888 | A | 6/1996 | Heidel |
| 5,584,483 | A | 12/1996 | Sines et al. |
| 5,586,766 | A | 12/1996 | Forte et al. |
| 5,586,936 | A | 12/1996 | Bennett et al. |
| 5,605,334 | A | 2/1997 | McCrea, Jr. |
| 5,613,912 | A | 3/1997 | Slater |
| 5,651,548 | A | 7/1997 | French et al. |
| 5,655,961 | A | 8/1997 | Acres et al. |
| 5,669,816 | A | 9/1997 | Garczynski et al. |
| 5,676,372 | A | 10/1997 | Sines et al. |
| 5,681,039 | A | 10/1997 | Miller |
| 5,683,085 | A | 11/1997 | Johnson et al. |
| 5,690,324 | A | 11/1997 | Otomo et al. |
| 5,692,748 | A | 12/1997 | Frisco et al. |
| 5,695,189 | A | 12/1997 | Breeding et al. |
| 5,707,287 | A | 1/1998 | McCrea, Jr. |
| 5,718,427 | A | 2/1998 | Cranford et al. |
| 5,722,893 | A | 3/1998 | Hill et al. |
| 5,735,525 | A | 4/1998 | McCrea, Jr. |
| 5,735,742 | A | 4/1998 | French |
| 5,772,505 | A | 6/1998 | Garczynski et al. |
| 5,779,546 | A | 7/1998 | Meissner et al. |
| 5,781,647 | A | 7/1998 | Fishbine et al. |
| 5,788,574 | A | 8/1998 | Ornstein et al. |
| 5,803,808 | A | 9/1998 | Strisower |
| 5,836,775 | A | 11/1998 | Hiyama et al. |
| 5,911,626 | A | 6/1999 | McCrea, Jr. |
| 5,919,090 | A | 7/1999 | Mothwurf |
| 5,936,222 | A | 8/1999 | Korsunsky et al. |
| 5,941,769 | A | 8/1999 | Order |
| 5,944,310 | A | 8/1999 | Johnson et al. |
| D414,527 | S | 9/1999 | Tedham |
| 5,985,305 | A | 11/1999 | Peery et al. |
| 5,989,122 | A | 11/1999 | Roblejo |
| 6,015,311 | A | 1/2000 | Benjamin et al. |
| 6,019,368 | A | 2/2000 | Sines et al. |
| 6,039,650 | A | 3/2000 | Hill |
| 6,068,258 | A | 5/2000 | Breeding et al. |
| 6,069,564 | A | 5/2000 | Hatano et al. |
| 6,071,190 | A | 6/2000 | Weiss et al. |
| 6,093,103 | A | 7/2000 | McCrea, Jr. |
| 6,117,012 | A | 9/2000 | McCrea, Jr. |
| 6,126,166 | A | 10/2000 | Lorson et al. |
| 6,127,447 | A | 10/2000 | Mitry et al. |
| 6,139,014 | A | 10/2000 | Breeding et al. |
| 6,149,154 | A | 11/2000 | Grauzer et al. |
| 6,154,131 | A | 11/2000 | Jones et al. |
| 6,165,069 | A | 12/2000 | Sines et al. |
| 6,165,072 | A | 12/2000 | Davis et al. |
| 6,213,310 | B1 | 4/2001 | Wennersten |
| 6,217,447 | B1 | 4/2001 | Lofink et al. |
| 6,236,223 | B1 | 5/2001 | Brady et al. |
| 6,250,632 | B1 | 6/2001 | Albrecht |
| 6,254,096 | B1 | 7/2001 | Grauzer et al. |
| 6,254,484 | B1 | 7/2001 | McCrea, Jr. |
| 6,267,248 | B1 | 7/2001 | Johnson et al. |
| 6,267,648 | B1 | 7/2001 | Katayama et al. |
| 6,267,671 | B1 | 7/2001 | Hogan |
| 6,270,404 | B2 | 8/2001 | Sines et al. |
| 6,293,864 | B1 | 9/2001 | Romero |
| 6,299,167 | B1 | 10/2001 | Sines et al. |
| 6,299,536 | B1 | 10/2001 | Hill |
| 6,313,871 | B1 | 11/2001 | Schubert |

(56) References Cited

U.S. PATENT DOCUMENTS 6,325,373 B1 12/2001 Breeding et al.
6,342,830 B1 1/2002 Want et al.
6,346,044 B1 2/2002 McCrea, Jr.
6,361,044 B1 3/2002 Block et al.
6,403,908 B2 6/2002 Stardust et al.
6,443,839 B2 9/2002 Stockdale et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,568,678 B2 5/2003 Breeding et al.
6,579,180 B2 6/2003 Soltys et al.
6,579,181 B2 6/2003 Soltys et al.
6,582,301 B2 6/2003 Hill
6,582,302 B2 6/2003 Romero
6,585,586 B1 7/2003 Romero
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,616,535 B1 9/2003 Nishizaki et al.
6,622,185 B1 9/2003 Johnson et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,652,379 B2 11/2003 Soltys et al.
6,655,684 B2 12/2003 Grauzer et al.
6,659,460 B2 12/2003 Blaha et al.
6,663,490 B2 12/2003 Soltys et al.
6,666,768 B1 12/2003 Akers
6,676,127 B2 1/2004 Johnson et al.
6,676,517 B2 1/2004 Beavers
6,680,843 B2 1/2004 Farrow et al.
6,685,567 B2 2/2004 Cockerille et al.
6,685,568 B2 2/2004 Soltys et al.
6,688,979 B2 2/2004 Soltys et al.
6,698,756 B1 3/2004 Baker et al.
6,712,696 B2 3/2004 Soltys et al.
6,719,634 B2 4/2004 Mishina et al.
6,726,205 B1 4/2004 Purton
6,732,067 B1 5/2004 Powderly
6,746,333 B1 6/2004 Onda et al.
6,758,751 B2 7/2004 Soltys et al.
6,758,757 B2 7/2004 Luciano, Jr. et al.
6,774,782 B2 8/2004 Runyon et al.
6,804,763 B1 10/2004 Stockdale et al.
6,834,251 B1 12/2004 Fletcher
6,848,616 B2 2/2005 Tsirline et al.
6,848,844 B2 2/2005 McCue, Jr. et al.
6,857,961 B2 2/2005 Soltys et al.
6,886,829 B2 5/2005 Hessing et al.
6,889,979 B2 5/2005 Blaha et al.
6,957,746 B2 10/2005 Martin et al.
6,959,925 B1 11/2005 Baker et al.
6,959,935 B2 11/2005 Buhl et al.
6,964,612 B2 11/2005 Soltys et al.
7,011,309 B2 3/2006 Soltys et al.
7,029,009 B2 4/2006 Grauzer et al.
7,036,818 B2 5/2006 Grauzer et al.
7,059,602 B2 6/2006 Grauzer et al.
7,066,464 B2 6/2006 Blad et al.
7,073,791 B2 7/2006 Grauzer et al.
7,084,769 B2 8/2006 Bauer et al.
7,106,201 B2 9/2006 Tuttle
7,113,094 B2 9/2006 Garber et al.
7,114,718 B2 10/2006 Grauzer et al.
7,124,947 B2 10/2006 Storch
7,139,108 B2 11/2006 Andersen et al.
7,213,812 B2 5/2007 Schubert et al.
7,237,969 B2 7/2007 Bartman
7,255,344 B2 8/2007 Grauzer et al.
7,322,576 B2 1/2008 Grauzer et al.
7,338,044 B2 3/2008 Grauzer
7,367,561 B2 5/2008 Blaha et al.
7,384,044 B2 6/2008 Grauzer et al.
7,413,191 B2 8/2008 Grauzer
7,448,626 B2 11/2008 Fleckenstein
7,510,186 B2 3/2009 Fleckenstein
7,523,935 B2 4/2009 Grauzer et al.
7,661,676 B2 2/2010 Smith et al.
7,753,373 B2 7/2010 Grauzer et al.
7,753,798 B2 7/2010 Soltys et al.
7,766,332 B2 8/2010 Grauzer et al.
7,867,080 B2 1/2011 Nicely et al.
7,901,285 B2 3/2011 Tran et al.
8,070,574 B2 12/2011 Grauzer et al.
8,141,875 B2 3/2012 Grauzer et al.
2001/0036231 A1 11/2001 Easwar et al.
2002/0107067 A1 8/2002 McGlone et al.
2002/0142820 A1 10/2002 Bartlett
2002/0187830 A1 12/2002 Stockdale
2003/0052450 A1 3/2003 Grauzer et al.
2003/0064798 A1 4/2003 Grauzer et al.
2003/0090059 A1 5/2003 Grauzer et al.
2003/0094756 A1 5/2003 Grauzer et al.
2003/0195025 A1 10/2003 Hill
2004/0067789 A1 4/2004 Grauzer et al.
2004/0100026 A1 5/2004 Haggard
2004/0224777 A1 11/2004 Smith et al.
2005/0035548 A1 2/2005 Yoseloff et al.
2005/0037843 A1 2/2005 Wells et al.
2005/0051956 A1 3/2005 Grauzer et al.
2005/0104289 A1 5/2005 Grauzer et al.
2005/0104290 A1 5/2005 Grauzer et al.
2005/0146093 A1 7/2005 Grauzer et al.
2005/0206077 A1 9/2005 Grauzer et al.
2005/0242500 A1 11/2005 Downs
2006/0033269 A1 2/2006 Grauzer et al.
2006/0046853 A1 3/2006 Black
2006/0063577 A1 3/2006 Downs et al.
2006/0181022 A1 8/2006 Grauzer et al.
2006/0279040 A1 12/2006 Downs et al.
2007/0006708 A1 1/2007 Laakso
2007/0102879 A1 5/2007 Stasson
2007/0278739 A1 12/2007 Swanson
2008/0006997 A1 1/2008 Scheper et al.
2008/0006998 A1 1/2008 Grauzer et al.
2008/0022415 A1 1/2008 Kuo et al.
2008/0111300 A1 5/2008 Czyzewski et al.
2008/0113700 A1 5/2008 Czyzewski et al.
2008/0303210 A1 12/2008 Grauzer et al.
2009/0191933 A1 7/2009 French
2010/0244382 A1 9/2010 Snow
2010/0276880 A1 11/2010 Grauzer et al.
2010/0314830 A1 12/2010 Grauzer et al.
2011/0109042 A1 5/2011 Rynda et al.

OTHER PUBLICATIONS

DVD Labeled "Luciano Decl. Ex. K". This is the video taped live Declaration of Mr. Luciano taken during preparation of litigation (Oct. 23, 2003).

DVD labeled Morrill Decl. Ex. A:. This is the video taped live Declaration of Mr. Robert Morrill, a lead trial counsel for the defense, taken during preparation for litigation. He is describing the operation of the Roblejo Prototype device. See Roblejo patent in 1449 or of record (Jan. 15, 2004).

DVD Labeled "Solberg Decl. Ex. C". This is the video taped live Declaration of Mr. Solberg, a witness for the defense, taken during preparation for litigation (Dec. 22, 2003).

(56) References Cited

OTHER PUBLICATIONS

DVD labeled Exhibit 1. This is a DVD taken by Shuffle Master personnel of the live operation of a CARD One2Six™ Shuffler (Oct. 7, 2003).
PCT International Search Report for PCT/US07/15035, dated Sep. 29, 2008, 3 pages.
PCT Written Opinion for PCT/US07/15035, dated Sep. 29, 2008, 3 pages.
Scarne's Encyclopedia of Games by John Scarne, 1973, "Super Contract Bridge", p. 153.
Service Manual/User Manual for Single Deck Shufflers: BG1, BG2 and BG3 by Shuffle Master © 1996.
Specification of Australian Patent Application No. 31577/95, filed Jan. 17, 1995, Applicants: Rodney G. Johnson et al., Title: Card Handling Apparatus.
Specification of Australian Patent Application No. Not Listed, filed Aug. 15, 1994, Applicants: Rodney G. Johnson et al., Title: Card Handling Apparatus.
PCT International Search Report and Written Opinion of the International Searching Authority for PCT/US2008/007069, dated Sep. 8, 2008, 10 pages.
PCT International Search Report for International Application No. PCT/US2007/022858, mailed Apr. 18, 2008.
PCT International Search Report for PCT/US07/15036, dated Sep. 23, 2008, 3 pages.
PCT Written Opinion for PCT/US07/15036, dated Sep. 23, 2008, 3 pages.
Press Release for Alliance Gaming Corp., Jul 26, 2004—Alliance Gaming Announces Control With Galaxy Macau for New Mind Play Baccarat Table Technology, http://biz.yahoo.com/prnews.
Tracking the Tables, by Jack Bularsky, Casino Journal, May 2004, vol. 17, No. 5, pp. 44-47.
Written Opinion of the International Searching Authority for International Application No. PCT/US2007/022858, mailed Apr. 18, 2008.
http://www.google.com/search?tbm=pts
&q=Card+handling+devicve+with+input+and+outpu . . . Jun. 8, 2012.
http://www.google.com/search?tbm=pts
&q=shuffling+zone+on+Oopposite+side+of+input+ . . . Jul. 18, 2012.
Google search for card handling device with storage area, card removing system pivoting arm and processor . . . ; http://www.google.com/?tbm=pts&hl=en; Jul. 28, 2012.
PCT International Search Report and Written Opinion of the International Searching Authority for PCT/US11/59797, dated Mar. 27, 2012, 14 pages.
Service Manual/User Manual for Single Deck Shufflers: BG1, BG2 and BG3 by Shuffle Master © 1997.

CARD HANDLING DEVICES AND RELATED METHODS

CROSS-REFERENCE TO RELATED APPLICATIONS

This application is a continuation of U.S. patent application Ser. No. 12/848,631, filed Aug. 2, 2010, now U.S. Pat. No. 8,141,875, issued Mar. 27, 2012, which is a continuation of U.S. patent application Ser. No. 11/598,259 filed Nov. 9, 2006, now U.S. Pat. No. 7,766,332, issued Aug. 3, 2010, which is a continuation-in-part of U.S. patent application Ser. No. 11/481,407, filed Jul. 5, 2006, now U.S. Pat. No. 8,342,525, issued Jan. 1, 2013, the disclosure of each of which is incorporated herein in its entirety by this reference. The subject matter of this application is also related to U.S. patent application Ser. No. 11/810,864, filed Jun. 6, 2007, now U.S. Pat. No. 8,070,574, issued Dec. 6, 2011.

FIELD

The present invention relates to devices for handling cards, including cards commonly known as "playing cards." In particular, the invention relates to an electromechanical machine for organizing or arranging playing cards into a plurality of randomly arranged groups of cards.

BACKGROUND

State of the Art

Wagering games based on the outcome of randomly generated arrangements of cards are well known. Such games are widely played in gaming establishments and, often, a single deck of 52 playing cards is used to play the game. Some games use multiple decks of cards (typically six or eight decks), such as blackjack and baccarat. Other games use two decks of cards, such as double-deck blackjack. Many specialty games use single decks of cards, with or without jokers and with or without selected cards removed. Examples of such games include THREE CARD POKER®, LET IT RIDE®, CARIBBEAN STUD® poker, SPANISH 21®, FOUR CARD POKER®, CRAZY 4 POKER® and others. As new games are developed, card shufflers are modified to be used in connection with the new games.

From the perspective of players, the time the dealer must spend in shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One approach is to simply speed up play. One option is to decrease the time the dealer spends shuffling.

The desire to decrease shuffling time has led to the development of mechanical and electromechanical card-shuffling devices. Such devices increase the speed of shuffling and dealing, thereby increasing actual playing time. Such devices also add to the excitement of a game by reducing the amount of time the dealer or house has to spend in preparing to play the game.

Dealers appreciate using card shufflers that place minimum strain on the dealer's hands, back and arms. Some existing shuffler designs put unnecessary strain on the muscles of the users. Dealers prefer shufflers that are low profile, especially when the shuffler dispenses cards into a game rather than shufflers that shuffle batches of cards for shoe games.

Numerous approaches have been taken to the design of card shufflers. These approaches include random ejection designs (e.g., U.S. Pat. Nos. 6,959,925; 6,698,756; 6,299,167; 6,019,368; 5,676,372; and 5,584,483), stack separation and insertion designs (e.g., U.S. Pat. Nos. 5,683,085 and 5,944,310), interleaving designs (e.g., U.S. Pat. Nos. 5,275,411 and 5,695,189), for example, random insertion using a blade (U.S. Pat. No. 5,382,024), and designs that utilize multiple shuffling compartments.

One such example of a compartment shuffler is disclosed in U.S. Pat. No. 4,586,712 to Lorber et al. The automatic shuffling apparatus disclosed is designed to intermix multiple decks of cards under the programmed control of a computer. The apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe. The container includes multiple card-receiving compartments, each one capable of receiving a single card.

Another shuffler having mixing compartments arranged in a carousel is disclosed in U.S. Pat. No. 6,267,248 to Johnson et al. Cards are loaded into an infeed tray, fed sequentially past a card reading sensor and are inserted into compartments within a carousel to either randomize or sort cards into a preselected order. The carousel moves in two directions during shuffling. U.S. Pat. No. 6,676,127 to Johnson et al. describes another variation of the shuffler, in which cards are inserted into and removed from a same side of the carousel, with the card infeed tray being located above the discard tray (see FIG. 3 of Johnson).

U.S. Pat. No. 3,897,954 to Erickson et al. discloses a device for delivering cards, one at a time, into one of a number of vertically stacked card-shuffling compartments. A logic circuit is used to determine the sequence for determining the delivery location of a card. The card shuffler can be used to deal stacks of shuffled cards to a player.

U.S. Pat. No. 4,770,421 to Hoffman discloses a card-shuffling device including a card loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence that is fixed as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir.

U.S. Pat. No. 5,275,411 to Breeding discloses a machine for automatically shuffling and dealing hands of cards. Although this device does not shuffle cards by distributing cards to multiple compartments, the machine is the first of its kind to deliver randomly arranged hands of cards to a casino card game. A single deck of cards is shuffled and then cards are automatically dispensed into a hand-forming tray. The shuffler includes a deck-receiving zone, a carriage section for separating a deck into two deck portions, a sloped mechanism positioned between adjacent corners of the deck portions, and an apparatus for snapping the cards over the sloped mechanism to interleave the cards. The Breeding shuffler was originally designed to be used in connection with single-deck poker-style games such as LET IT RIDE® stud poker and a variant of pai gow poker marketed as WHO'S FIRST™ pai gow poker.

In an attempt to speed the rate of play of specialty table games equipped with a shuffler, the ACE® card shuffler, as disclosed in U.S. Pat. Nos. 6,149,154, 6,588,750, 6,655,684 and 7,059,602, was developed. This shuffler operates at faster speeds than previously known shuffler devices described above, has fewer moving parts and requires much shorter setup time than the prior designs. The shuffler includes a card infeed tray, a vertical stack of shuffling compartments and a card output tray. A first card moving mechanism advances cards individually from the infeed tray into a compartment. A processor randomly directs the placement of fed cards into the compartments, and an alignment of each compartment with the first card mover, forming random groups of cards within each compartment. Groups of cards are unloaded by a second card moving mechanism into the output tray.

Another compartment shuffler capable of delivering randomly arranged hands of cards for use in casino card games is the ONE2SIX® shuffler (developed by Casinos Austria Research & Development (CARD)). This shuffler is disclosed in U.S. Pat. Nos. 6,659,460 and 6,889,979. This shuffler is capable of delivering randomly arranged hands of cards when a first delivery end is attached, and is capable of delivering a continuous supply of cards from a shoe-type structure when a second delivery end is attached. Cards are fed from a feeder individually into compartments within a carousel to accomplish random ordering of cards.

Most of the known shuffler designs are high profile and require loading cards into the rear of the machine, and then removing cards from the front of the machine. The cards must be lifted over the top of the machine to return spent cards to the infeed tray, causing a dealer to lift his arm over the top of the machine at the conclusion of each round of play.

One particular type of card-shuffling device is referred to as a batch-type shuffler. One characteristic of a (single- or double-deck) batch shuffler is that, when all of the cards are dispensed in a round of play, the remaining cards in the pack (one or two decks) are removed and then reinserted. In use, while the game is being dealt using a first deck, a second deck of cards is being randomized and arranged into groups. A discard rack is typically provided on the table so that cards removed from the game are staged in the rack while the other deck of cards is being processed. Following this procedure avoids the possibility that cards will be returned to the input tray and that the two decks will be intermingled. The use of two separate decks (one at a time) speeds game play because shuffling occurs during play.

U.S. Pat. No. 6,959,925 to Baker et al. discloses a single-deck continuous card shuffler known in the trade as the POKERONE®. This shuffler avoids the alternating use of two different decks of cards during a specialty card game by providing a continuous supply of cards to a card game. Although this shuffler uses only one deck of cards, the shuffler does not verify that the correct number of cards (typically 52) are present prior to each shuffle, and, consequently, player cheating by inserting extra cards would go undetected.

Shufflers that communicate with network-based game systems have been described in the art. An example is described in U.S. Patent Application Publication No. 2003/0064798 A1. A shuffler with an on-board microprocessor and communication port communicates with a local processor and/or a central processor. The local or central processor may manage a game system.

It would be advantageous to provide a shuffler that has all of the performance attributes of known shufflers, has state-of-the-art security features, that eliminates the need for a discard rack and provides an ergonometric design for end users.

BRIEF SUMMARY

In one embodiment, the present invention includes a card handling device comprising a control system configured to selectively control at least one of a card infeed system, a card storage system, and a card output system of the card handling device in response to at least one signal received from a card sensing system. The control system may be configured to enable a user to selectively perform each of a shuffling operation, a sorting operation, and a dealing operation using the card handling device.

In another embodiment, the present invention includes a card handling device having a card output tray, a card sensing system, and a control system. The card sensing system may be used to identify cards handled by the card handling device, and the control system may be configured to selectively control at least one of a card infeed system, a card storage system, and a card output system of the card handling device in response to at least one signal received from the card sensing system. The control system may be further configured to cause the card handling device to dispense a first playing hand or subset of cards into the card output tray and to dispense at least a second playing hand or subset of cards into the card output tray after the first hand or subset of cards is removed from the card output tray in response to a first input signal, and to cause the card handling device to selectively perform at least one of a shuffling operation and a sorting operation in response to a second input signal.

In yet another embodiment, the present invention includes a method of dealing hands or subsets of cards from a set of cards to persons in a game. The method includes placing a set of cards in a card infeed tray of a card handling device and causing the card handling device to substantially automatically randomly generate a first hand or subset of cards from the set of cards and dispense the first hand or subset of cards to a card output tray. The first hand or subset of cards is removed from the card output tray, and the card handling device may be caused to substantially automatically randomly generate at least a second hand or subset of cards from the set of cards and dispense the second hand or subset of cards to the card output tray after removing the first hand or subset of cards from the card output tray.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION

The illustrations presented herein should not be interpreted in a limiting sense as actual views of any particular apparatus or system, but are merely idealized representations which are employed to describe the present invention. Additionally, elements common between figures may retain the same numerical designation.

The disclosures of all patents, published patent applications and other documents cited in this entire application are incorporated by reference in their respective entireties herein, whether or not such incorporation is specifically asserted in association with such citation.

Card handling devices that embody teachings of the present invention may include major components that are physically arranged (for example, in a linear arrangement) in the following order: a) a playing card input compartment; b) a playing card retrieval compartment; and c) a playing card handling zone. Playing cards may be moved from the playing card input compartment into the playing card handling zone and from the playing card handling zone into the playing card retrieval compartment. Furthermore, card handling devices that embody teachings of the present invention may be configured to enable a user to either shuffle or selectively sort cards into a predefined order using the card handling devices.

Figure 1:
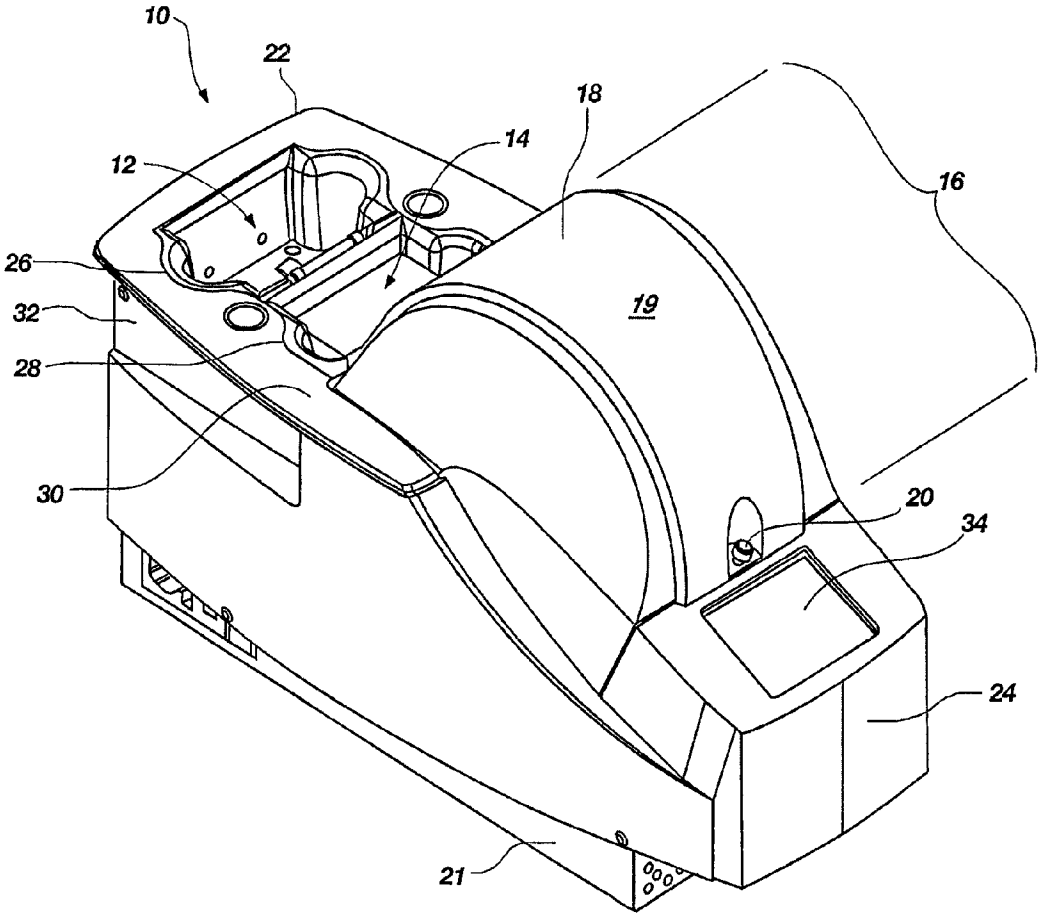
FIG. 1 is a perspective view of a first embodiment of a card handling device that embodies teachings of the present invention.

A perspective view of a card handling device 10 that embodies teachings of the present invention is shown in FIG. 1. The card handling device 10 includes a card infeed tray 12, a card output tray 14, and a card handling system or mechanism, which is described in further detail below. In some embodiments, the card output tray 14 may be removable for maintenance.

In some embodiments, the card infeed tray 12 and the card output tray 14 may be disposed adjacent one another. Furthermore, the card infeed tray 12 and the card output tray 14 each may be located near a first end 22 of the card handling device 10. In some embodiments, the card infeed tray 12 and the card output tray 14 may each include a recessed area in the card handling device 10, as shown in FIG. 1.

A major portion of the card handling system may be located within a card handling zone 16 of the card handling device 10. The card handling system may be enclosed within a cover 18, which, in this embodiment, has a curved upper surface 19 that is arched to enclose an upper portion of a carousel member (which is part of the card handling system described in further detail below). The cover 18 may include a lock 20 to secure the cover 18 to a frame 21 of the card handling device 10 to prevent unauthorized access to cards in the card handling device 10. This locking feature advantageously allows a casino operator to shut down a table with cards loaded into the card handling device 10. When the table is reopened, the operator can be assured that the cards held in the machine are secure. The key to the lock 20 may be held by pit management and the fact that the cover 18 is and has been locked may eliminate any need to unload and verify the rank and suit of each card before play is resumed. Securing the cards within the card handling device 10 when the machine is not in use is a valuable time- and labor-saving feature. The lock 20 may be located proximate a second end 24 of the card handling device 10. Although an exemplary lock is a simple mechanical lock with rollers and a key, other locking systems may be used, such as, for example, electronic locks with keypad controls, locking systems that receive radio frequency identification (RFID) signatures, and computer-controlled locks.

Figure 2:
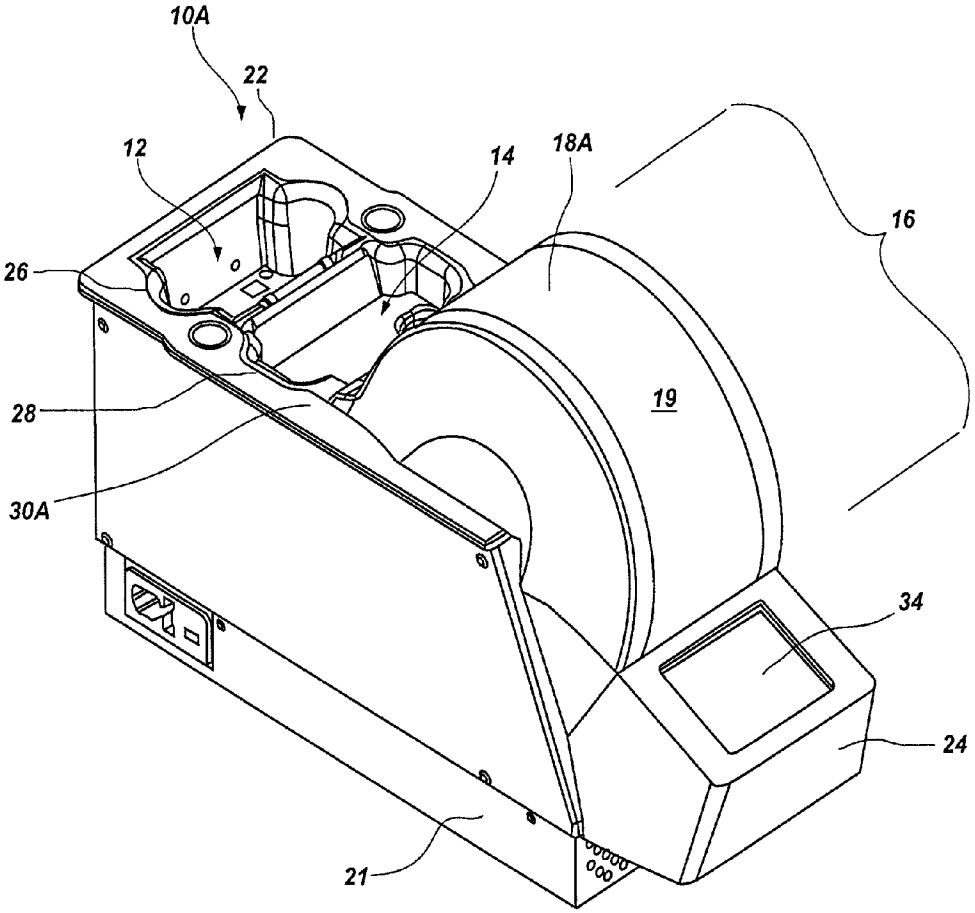
FIG. 2 is a perspective view of another embodiment of a card handling device that embodies teachings of the present invention.

Additional card handling devices that embody teachings of the present invention may not include an outer cover that is intended to be opened or removed by a user. For example, FIG. 2 illustrates another card handling device 10A that embodies teachings of the present invention and that includes an outer cover 18A that is not intended to be opened or removed by a user. The card handling device 10A may be otherwise substantially similar to the card handling device 10, as shown in FIG. 1, and may include a card infeed tray 12, a card output tray 14 near a first end 22 of the card handling device 10A, and a card handling zone 16 and a display 34 near a second end 24 of the card handling device 10A. A card handling mechanism comprising a carousel (not shown) is enclosed within the outer cover 18A. The outer cover 18A may be secured to a frame 21 and may be removable for maintenance, but may not be configured for removal by a user. In some embodiments, the outer cover 18A may be secured to the frame 21 with sheet metal screws. The card handling device 10A may further include a flange 30A that intersects an upper edge 26 of the card infeed tray 12 and an upper edge 28 of the card output tray 14 and extends a portion of the way through the card handling zone 16. This flange 30A may be mounted on a gaming table surface such that a portion of the card handling zone 16 is positioned within the outside perimeter of the gaming table. The display 34 may be positioned at an elevation below the gaming table surface when the card handling device 10A is mounted on or in a gaming table. The card handling device 10A may be supported by the flange 30A, a table extension (not shown), a pedestal, a combination of the above, or by any other support technique.

Referring again to FIG. 1, the card infeed tray 12 and the card output tray 14 may be surrounded by a substantially flat flange 30 that intersects an upper edge 26 of the card infeed tray 12 and an upper edge 28 of the card output tray 14. In this configuration, the flat flange 30, the upper edge 26 of the card infeed tray 12, and the upper edge 28 of the card output tray 14 may be disposed in substantially the same plane. In other words, the upper edge 26 of the card infeed tray 12 and the upper edge 28 of the card output tray 14 may be substantially co-planar. In such a configuration, the card handling device 10 may be mounted for use on or in a gaming table such that the flat flange 30, the upper edge 26 of the card infeed tray 12, and the upper edge 28 of the card output tray 14 are substantially flush with the upper surface of the gaming table.

In one mounting arrangement, a gaming table surface may be provided with a notch cut into an edge of the table facing the dealer. The first end 22 of the card handling device 10 may include a recess 32 that has a size and shape that is configured to receive the side of the table therein along the notch. The remainder of the card handling device 10 (e.g., the second end 24 of the card handling device 10) may be supported by a support bracket beneath the table surface. In this configuration, the portion of the card handling device 10 that is inserted into the gaming table may be flush-mounted with the upper surface of the table.

In the arrangement described above, the first end 22 of the card handling device 10 may be nearest the players and the second end 24 of the card handling device 10 may be nearest the pit when the card handling device 10 is mounted on or in a gaming table. Furthermore, the card handling zone 16 may be located behind or to the side of the dealer and out of the way when the card handling device 10 is mounted on or in the gaming table.

The relative arrangement of the card infeed tray 12, the card output tray 14, and the card handling zone 16 in the card handling device 10, as shown in FIG. 1, may provide certain advantages. Because the card infeed tray 12 and the card output tray 14 are located on the same side of the card handling zone 16 (near the first end 22 of the card handling device 10), the cards may be more accessible to the dealer, and the dealer need not lift cards over the card handling zone 16 to place spent cards back into the card handling zone 16. The present design, therefore, may be relatively more ergonomically beneficial to the user (dealer) than known designs. Positioning the card infeed tray 12 at the table level also may reduce the possibility that card faces will be accidentally shown to players.

The placement of the upper edge 26 of the card infeed tray 12 and the upper edge 28 of the card output tray 14 substantially in the same plane lying on or proximate to the gaming surface also may provide distinct ergonometric advantages. If the dealer moves his or her hands smaller distances during card handling, he or she is likely to experience fewer repetitive stress or strain injuries. Therefore, delivering spent cards to the card handling device 10 at the gaming surface and retrieving freshly handled cards from substantially the same location or nearby offers distinct user advantages.

The placement of the card infeed tray 12 and the card output tray 14 on the same side of a carousel-type playing card handling zone 16 (discussed in further detail below) also allows the user to place spent cards face-down in the card infeed tray 12, and at the same time receive fresh cards from the card output tray 14 in a face-down configuration. This attribute has been previously described in U.S. Pat. No. 6,676,127 to Johnson et al. This feature improves the security of a carousel card handling device 10, since no cards are exposed during loading, shuffling, or unloading.

A horizontally disposed centerline intersecting the card infeed tray 12 and the card output tray 14 may also advantageously intersect a centerline of the card handling zone 16, as will be discussed in more detail below. This arrangement allows the machine to be fairly narrow in width and permits both card tray areas (but not the more bulky card handling zone 16) to be located on or near the playing table surface.

The card handling zone 16 of the card handling device 10 may include card moving elements located below the card infeed tray 12 and the card output tray 14. The card handling zone 16 may be capable of performing at least one of the following functions: a) shuffling, b) arranging cards into a desired order, c) verifying completeness of a group of cards, d) reading special markings on cards (such as, for example, a casino identification mark, a manufacturer identification mark, a special bonus card identification mark, a deck identification mark, etc.), e) scanning cards for unauthorized markings, f) identifying cards lacking required markings, g) measuring card wear, h) decommissioning cards, i) applying markings to cards, j) scanning cards for unauthorized electronic devices, k) delivering special cards such as, for example, bonus cards, promotional cards, or wild cards, and many other useful functions.

In some embodiments of the present invention, the card handling zone 16 may comprise a card handling system or mechanism comprising a temporary card storage device or system 244 (FIG. 8), a card infeed mechanism or system 240 (FIG. 8) for moving cards from the card infeed tray 12 to the temporary card storage system 244 (FIG. 8), and a card output mechanism or system 242 (FIG. 8) for moving cards from the temporary card storage system 244 (FIG. 8) to the card output tray 14. In some embodiments of the present invention, the temporary card storage system 244 (FIG. 8) may comprise a carousel device having multiple compartments for receiving cards therein, as discussed in further detail below. Many types of card handling systems or mechanisms that include other types of temporary card storage devices may be utilized in card handling devices that embody teachings of the present invention. Some non-limiting examples of such other types of card handling systems or mechanisms include the card handling system described in detail in U.S. Pat. No. 6,959,925 to Baker et al., the vertical compartment card handling system described in U.S. Pat. No. 6,149,154 to Grauzer et al., and the card handling system described in U.S. Pat. No. 6,651,981 to Grauzer et al.

Figure 3:
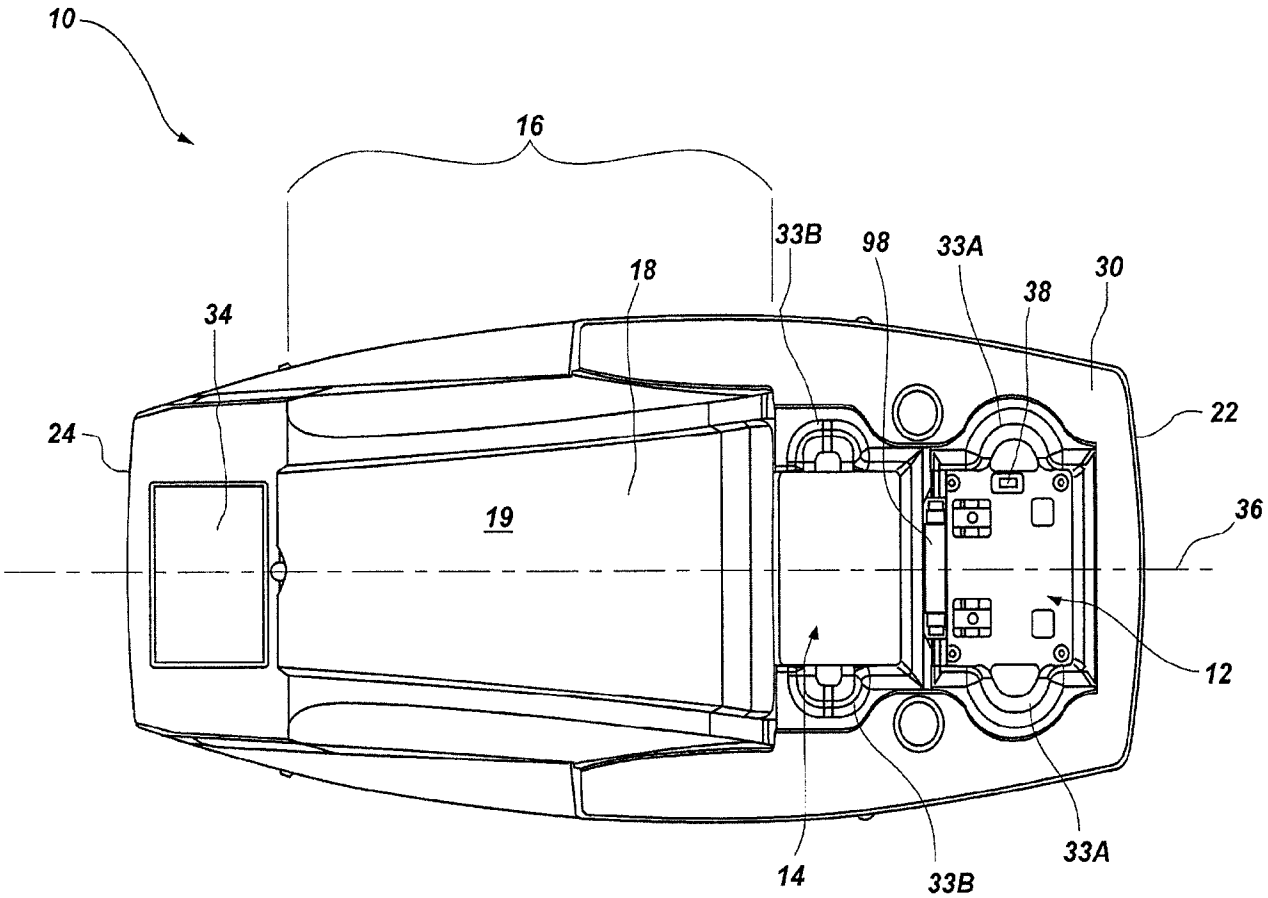
FIG. 3 is a top plan view of the card handling device shown in FIG. 1.

FIG. 3 is a top plan view of the card handling device 10 shown in FIG. 1. The card infeed tray 12 and the card output tray 14 may be positioned on the same side of the card handling device 10 and in substantially a common plane. For example, the card infeed tray 12 and the card output tray 14 each may be positioned proximate the first end 22 of the card handling device 10. Furthermore, the card infeed tray 12 and the card output tray 14 each may be positioned on the same side of the card handling zone 16 (which may include, for example, a carousel 120, as discussed in further detail below). In some embodiments of the present invention, the card infeed tray 12 and the card output tray 14 each may be bisected by a centrally located longitudinal axis 36. Furthermore, in some embodiments, the card infeed tray 12 and the card output tray 14 each may be substantially symmetrically bisected by the longitudinal axis 36. As also shown in FIG. 3, the card infeed tray 12 may be equipped with a gate member 98 whose functions will be described in more detail below. The card infeed tray 12 also may include a sensor 38 configured to detect the presence of any card provided in the card infeed tray 12.

Declining finger cut-outs 33A or recesses may be provided in the interior surfaces of the card infeed tray 12, and declining finger cut-outs 33B or recesses may be provided in the interior surfaces of the card output tray 14. The finger cut-outs 33A, 33B may have a size and shape configured to receive or accommodate at least one digit of the hand of a person therein to facilitate handling of cards in the card infeed tray 12 and the card output tray 14 by a user.

Figure 4A:
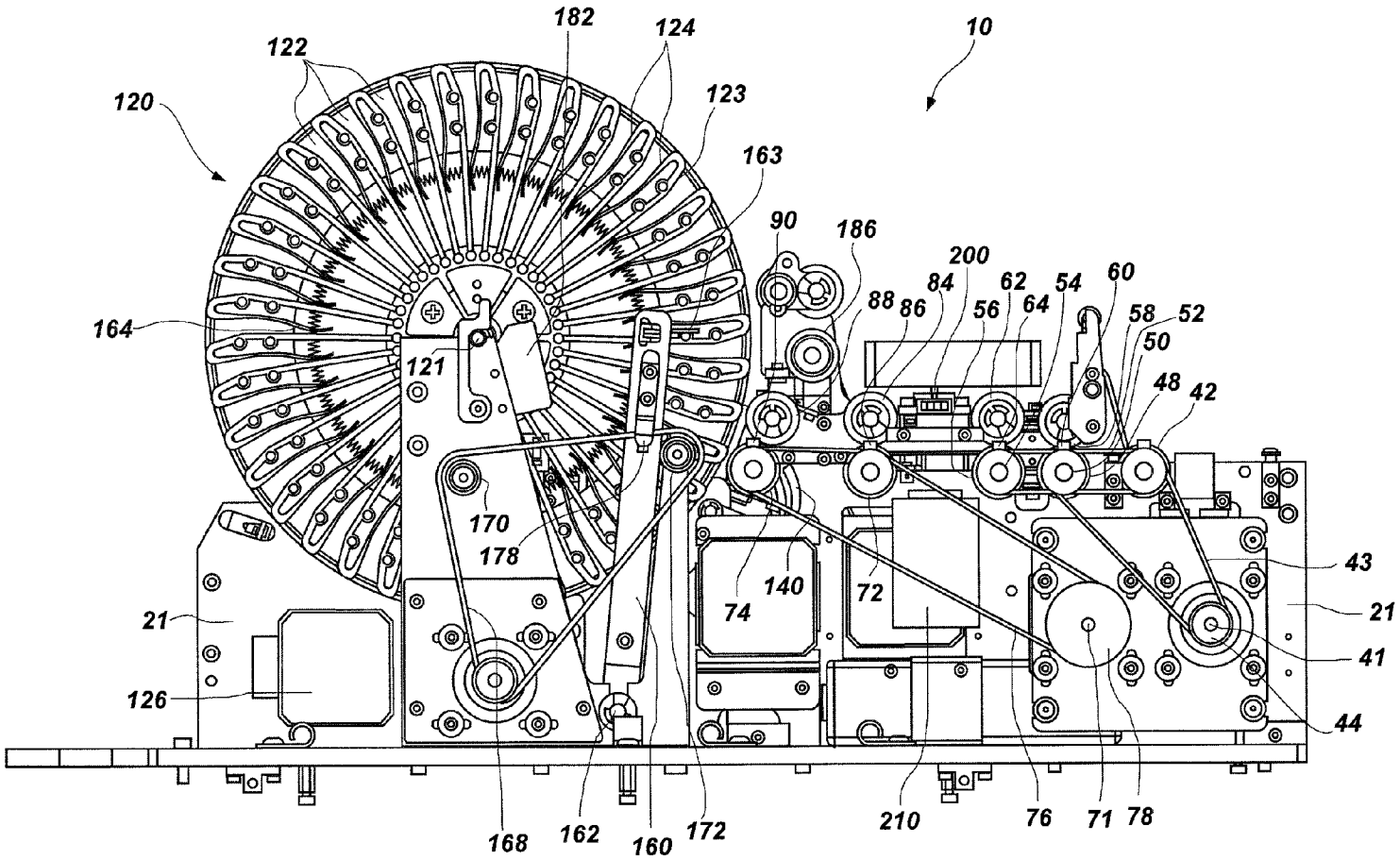
FIG. 4A is a view of a first side of the card handling device shown in FIG. 1 with the cover removed to facilitate illustration of active components of the card handling device.
Figure 4B:
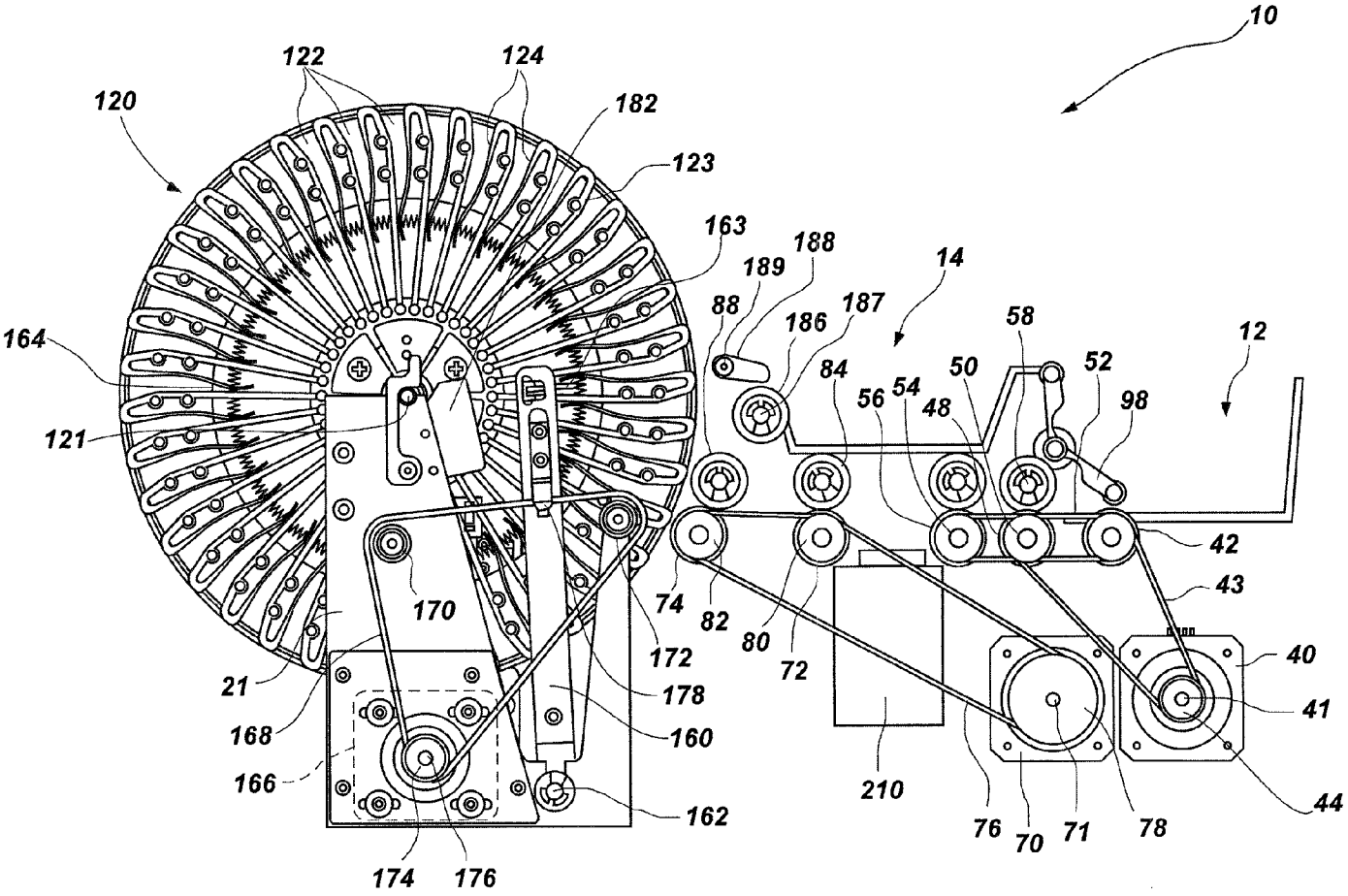
FIG. 4B is a simplified version of FIG. 4A, illustrating only selected elements to facilitate description of those elements.

FIG. 4A is a side view of the card handling device 10 shown in FIG. 1 with the cover 18 removed. FIG. 4B is a simplified version of FIG. 4A, illustrating only certain elements of the card handling device 10 to facilitate description thereof. Referring to FIGS. 4A and 4B in combination, the card handling device 10 may include a card infeed system 240 (FIG. 8) comprising a first drive system and a second drive system.

The first drive system may include a first card infeed motor 40 (FIG. 4B) that is configured to drive rotation of a card feed roller 42 using a first endless toothed belt 43 coupled to both a drive sprocket 44, which is mounted on a drive shaft 41 of the first card infeed motor 40, and the card feed roller 42. A lowermost card in a stack of spent cards placed in the card infeed tray 12 will come into contact with card feed roller 42. The first card infeed motor 40 is also configured to rotationally drive a first advancing roller 48 using the first endless toothed belt 43. A second endless toothed belt 52 meshes with a sprocket 50 as well as a sprocket 54 on a shaft carrying a second advancing roller 56. In this configuration, as the first card infeed motor 40 drives rotation of the card feed roller 42 and the first advancing roller 48 with the first endless toothed belt 43, the first card infeed motor 40 will also drive rotation of the second advancing roller 56 with the second endless toothed belt 52. First opposing idler roller 58 adjacent the first advancing roller 48 forms a first nip 60, and second opposing idler roller 62 forms a second nip 64 (FIG. 4A). The first opposing idler roller 58 may be adjustable in the vertical direction of FIG. 4A. Cards provided in the card infeed tray 12 (FIG. 4B) may be sequentially moved in the horizontal direction of FIGS. 4A and 4B by the card feed roller 42 into the first nip 60, and subsequently into the second nip 64.

The second drive system may include a second card infeed motor 70 (FIG. 4B) that is configured to drive rotation of a third advancing roller 72 and a fourth advancing roller 74 using a third endless toothed belt 76 that is coupled to a pulley 78 mounted on a drive shaft 71 of the second card infeed motor 70, a pulley 80 mounted on a shaft carrying the third advancing roller 72, and a pulley 82 mounted on a shaft carrying the fourth advancing roller 74. A third opposing idler roller 84 adjacent the third advancing roller 72 forms a third nip 86 (FIG. 4A), and a fourth opposing idler roller 88 forms a fourth nip 90 (FIG. 4A). The fourth opposing idler roller 88 and the fourth nip 90 may be oriented and configured to deflect a card passing therebetween upwardly and into a compartment 122 or other card storage area of a carousel 120 or other temporary card storage device.

The first card infeed motor 40 and the second card infeed motor 70 each may be operatively controlled by a control system 220 (FIG. 8), which is described in further detail below.

In additional embodiments of the present invention, the card infeed system 240 (FIG. 8) may include only one motor, or more than two motors. Additionally, the card infeed system 240 (FIG. 8) may include any number of advancing rollers and corresponding idler rollers. Furthermore, any means for rotationally driving the card feed roller 42 and the advancing rollers 48, 56, 72, 74 may be used, including, for example, gears, sprockets, chains, belts, etc. In yet additional embodiments, the card feed roller 42 and each of the advancing rollers 48, 56, 72, 74 may be directly mounted on a drive shaft of a corresponding motor.

Figure 5:
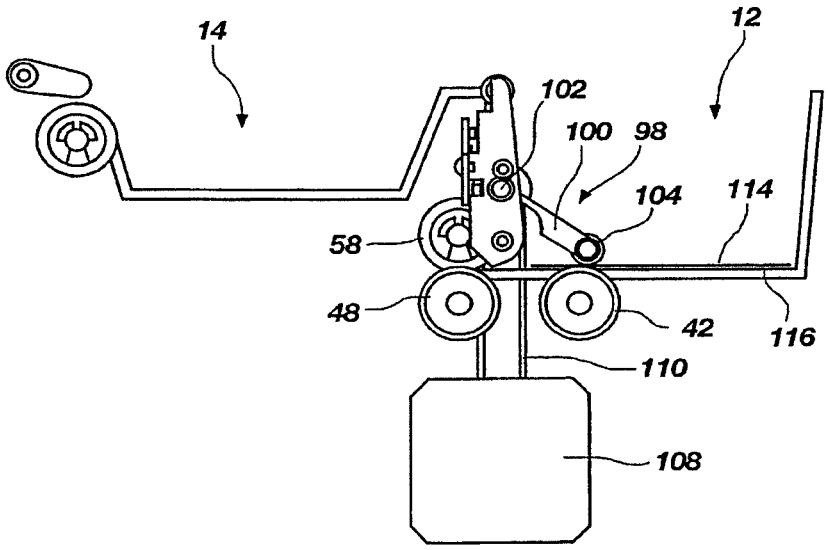
FIG. 5 is an enlarged partial view of a card infeed tray, a card feed roller, and a dual-function gate of the card handling device shown in FIG. 1.

Referring to FIG. 5, in some embodiments of the present invention, the card infeed system 240 (FIG. 8) of the card handling device 10 may further include a gate member 98 operatively associated with the card infeed tray 12. The gate member 98 may comprise an extension arm 100 having a first end that is connected to a shaft 102. The shaft 102 may be rotationally driven by an infeed gate motor 108 and an endless belt 110. A roller 104 may extend substantially transversely from the extension arm 100 (i.e., into the plane of FIG. 5), and may be used to reduce frictional contact with cards 114 in the card infeed tray 12. The roller 104 may be rotationally coupled to the second end of the extension arm 100, and may extend substantially across a width of any cards 114 in the card infeed tray 12 (or a length of any cards 114 in the card infeed tray 12, depending on the orientation of the cards 114 in the card infeed tray 12). In this configuration, the extension arm 100 will pivot about the shaft 102 as the infeed gate motor 108 drives rotation of the shaft 102 using the endless belt 110. The extension arm 100 and roller 104 may be positioned in an upright and retracted pivotal position (not shown) in which the roller 104 does not engage any cards 114 in the card infeed tray 12, to a downwardly angled engaged position in which the roller 104 engages and abuts against the cards 114 in the card infeed tray 12.

Figure 8:
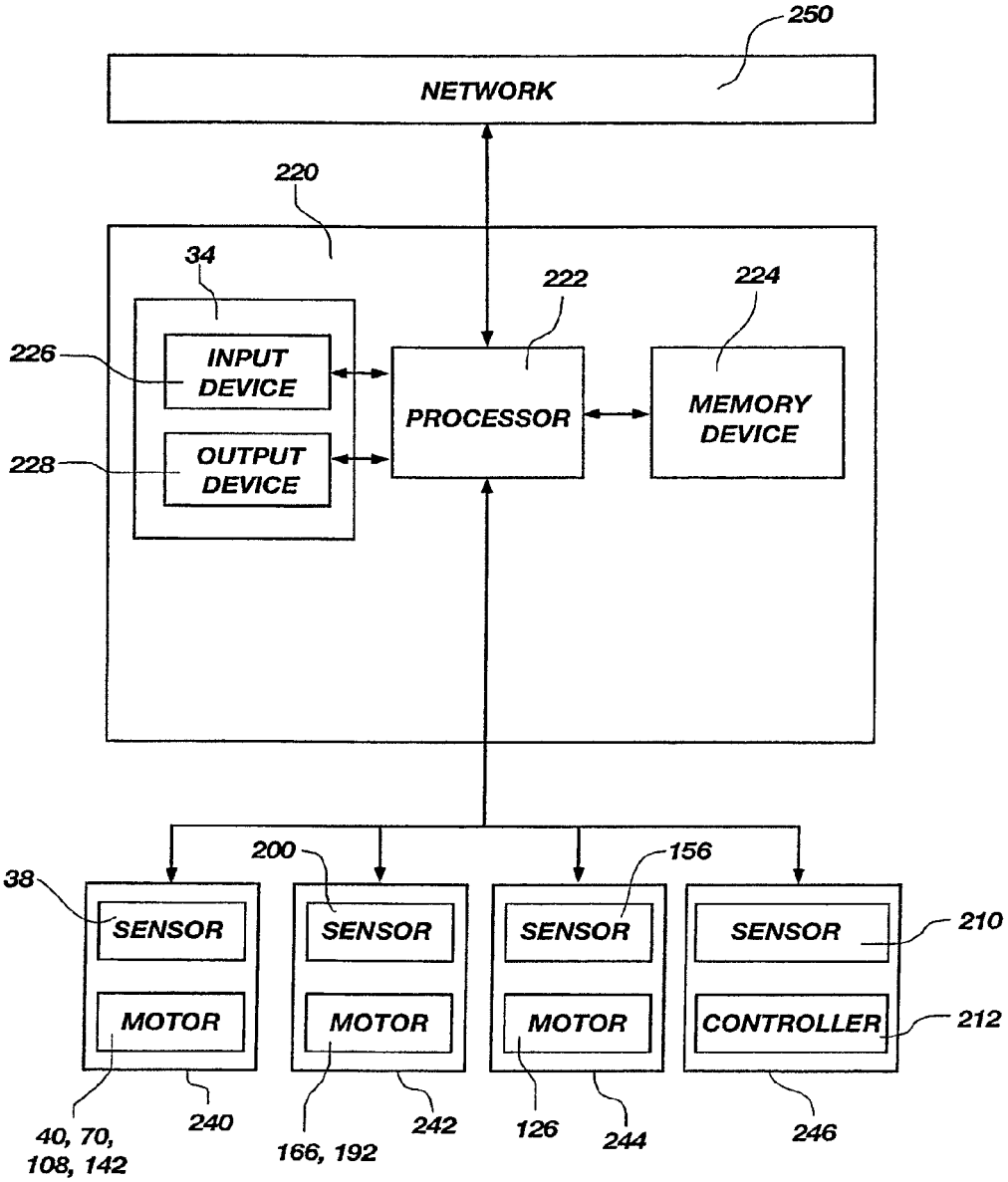
FIG. 8 is a schematic diagram of a control system that may be used in card handling devices that embody teachings of the present invention, such as that shown in FIG. 1.

The gate member 98 may serve a number of functions. For example, as the number of cards 114 in the card infeed tray 12 is reduced, the weight of the stack of cards 114 in the card infeed tray 12 is reduced, which may reduce the frictional force between the lowermost card 114 in the card infeed tray 12 and the card feed roller 42. The reduced frictional force between the lowermost card 114 in the card infeed tray 12 and the card feed roller 42 may impair the ability of the card feed roller 42 to move the lowermost card 114 to the first advancing roller 48 and to other elements of the card infeed system 240 (FIG. 8). Therefore, the gate member 98 may be used to apply a downward force to the cards 114 in the card infeed tray 12 to maintain the frictional force between the lowermost card 114 in the card infeed tray 12 and the card feed roller 42 above a threshold level. In some embodiments, the gate member 98 may be used to apply a downward force to the cards 114 in the card infeed tray 12 that increases as the number of remaining cards 114 decreases to provide a substantially constant force to the lowermost card 114 in the card infeed tray 12. In other words, the gate member 98 provides additional weight against the cards 114 in the card infeed tray 12, which may improve the reliability by which the cards 114 in the card infeed tray 12 are taken into the first nip 60 (FIG. 4A) by the card feed roller 42.

The gate member 98 also may be used to provide a physical separation barrier between cards 114 in the card infeed tray 12 belonging or corresponding to different decks, or between different types of cards (such as regular cards and bonus cards, for example). When the card infeed system 240 (FIG. 8) of the card handling device 10 is actively moving cards 114 from the card infeed tray 12 to the carousel 120 (FIG. 4A) or other card storage device, the gate member 98 may be in the previously described downwardly engaged position. At the same time, the dealer may be collecting spent cards 114 from the playing table. Because the gate member 98 is in the downwardly engaged position, the dealer may put the spent cards 114 (which may correspond to a first deck) in the card infeed tray 12 on top of or over at least a portion of the gate member 98, while the cards 114 previously placed in the card infeed tray 12 (which may correspond to a second, different deck) are being moved from the card infeed tray 12 to the carousel 120 by the card infeed system 240 (FIG. 8). Therefore, in some embodiments of the present invention, a dealer or other user may load cards 114 from a first deck into the card infeed tray 12 while at least some cards 114 from a second deck remain in the card infeed tray 12 without causing or allowing the card handling device 10 to mix cards 114 from the first deck with cards 114 from the second deck. As a result, the use of the gate member 98 may permit a casino to eliminate use of discard racks (which are typically mounted on gaming table surfaces for holding spent cards until they can be fed into a card handling device), as spent cards 114 may be placed without delay directly into the card infeed tray 12.

Once the last of the cards 114 below the gate member 98 in the card infeed tray 12 has been removed from the card infeed tray 12 by the card infeed system 240 (FIG. 8), the gate member 98 may be caused to rotate about the shaft 102 to the previously described retracted position to allow any cards 114 previously placed over the gate member 98 in the card infeed tray 12 to fall to the bottom of the card infeed tray 12 adjacent the card feed roller 42. In the retracted position, the gate member 98 may not obstruct the user from inserting additional cards 114 into the card infeed tray 12.

The shaft 102 may be located a selected distance below the upper edge 26 of the card infeed tray 12 (FIG. 1) so that the roller 104 does not extend substantially above the upper edge 26 of the card infeed tray 12 when the gate member 98 is in the previously described retracted position. Furthermore, the shaft 102 may be located a selected distance above a bottom surface 116 of the card infeed tray 12 to enable at least one entire deck of cards 114 to be received in the card infeed tray 12 and allow the roller 104 to abut against the top card 114 in the at least one entire deck of cards 114. Furthermore, the extension arm 100 may have a selected length to provide a distance between the rotational axis of the shaft 102 and the rotational axis of the roller 104 that is short enough that cards 114 provided over the gate member 98 in the card infeed tray 12 will lift and fall to the bottom surface 116 of the card infeed tray 12 without flipping over as the gate member 98 pivots upwardly in the counterclockwise direction of FIG. 5. A preferred gate length is about one-third the length of the cards 114 (or the width of the cards 114, depending on the orientation of the cards 114 in the card infeed tray 12).

The infeed gate motor 108, which is used to selectively rotate the gate member 98, may be operatively controlled by a control system 220 (FIG. 8), which is described in further detail below.

Referring again to FIG. 4A, the card infeed system 240 (FIG. 8) of the card handling device 10 may further include a packer arm device 140 for assisting the insertion of a card into a compartment 122 of the carousel 120 or other card storage device. As shown in FIGS. 4A and 4B, each compartment 122 of the carousel 120 may include a leaf spring member 124. As a result, the force of each leaf spring member 124 may need to be overcome as a card is inserted into each compartment 122. The packer arm device 140 may be used to provide additional force to the card as it leaves the fourth advancing roller 74 and corresponding fourth opposing idler roller 88 and enters a compartment 122 of the carousel 120.

Figure 6:
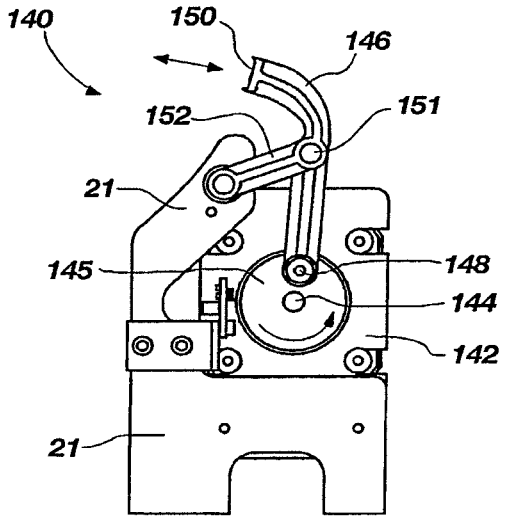
FIG. 6 is an enlarged detailed view of a packer arm assembly of the card handling device shown in FIG. 1.

FIG. 6 is an enlarged stand-alone view of one embodiment of a packer arm device 140 that may be used in card handling devices that embody teachings of the present invention, such as the card handling device 10 shown in FIG. 1. As shown in FIG. 6, the packer arm device 140 may include a packer arm motor 142, which may be mounted to the frame 21 of the card handling device 10. The packer arm motor 142 may be configured to rotate a shaft 144. An eccentric cam member 145 may be mounted to the shaft 144. An elongated packer arm 146 configured as a lever member may be pivotally coupled at a first end 148 thereof to the eccentric cam member 145. The elongated packer arm 146 also may be pivotally attached to a first end of a pivot arm member 152 at an intermediate location 151 along the elongated packer arm 146 between the first end 148 and a second end 150 thereof. A second end of the pivot arm member 152 may be pivotally attached to the frame 21 of the card handling device 10 or another stationary element of the card handling device 10.

In this configuration, as the packer arm motor 142 drives rotation of the shaft 144 and eccentric cam member 145 in the direction indicated by the directional arrow shown on the eccentric cam member 145 in FIG. 6, the second end 150 of the elongated packer arm 146 may rock back and forth along an arc-shaped path in the directions indicated by the bi-directional arrow shown proximate the second end 150 of the elongated packer arm 146 in FIG. 6.

The packer arm device 140 may be located in the card handling device 10 such that the second end 150 of the elongated packer arm 146 will abut against a trailing edge of a card and force the card completely into an aligned compartment 122 of the carousel 120. As the eccentric cam member 145 continues to rotate, the second end 150 of the elongated packer arm 146 may retract to a position that will allow a subsequent card to move past the packer arm device 140 and into position for insertion into a compartment 122 of the carousel 120. In some embodiments of the present invention, the subsequently described control system 220 may cause the elongated packer arm 146 to retract while the carousel 120 is rotating and to extend when the carousel 120 is stationary.

The packer arm motor 142, which is used to selectively move the elongated packer arm 146, also may be operatively controlled by a control system 220, which is described in further detail below.

Referring again to FIG. 4A, as previously discussed, the carousel 120 may include a plurality of compartments 122, each of which may include a leaf spring 124 for holding cards securely within the compartment 122 after insertion. In this configuration, the cards may remain secured within the compartments 122 as the carousel 120 rotates in either the clockwise or counterclockwise direction of FIG. 4A. Each compartment 122 also may have at least one beveled surface 123 for deflecting cards into the aligned compartment 122 during insertion. In some embodiments of the present invention, the compartments 122 of the carousel 120 may be substantially equally sized, and each may be capable of holding up to ten conventional playing cards. By way of example and not limitation, the carousel 120 may include thirty-eight (38) compartments 122. In additional embodiments, the carousel 120 may include fewer than thirty-eight (38) compartments 122 or more than thirty-eight (38) compartments 122.

In some embodiments of the present invention, the previously described card infeed system 240 (FIG. 8) may be capable of selectively inserting a card into a compartment 122 of the carousel 120 either below or above any cards previously inserted and still disposed within that respective compartment 122. For example, each compartment 122 may have two corresponding card insertion rotational positions of the carousel 120. When the carousel 120 is rotationally positioned in the first of the card insertion rotational positions, any card inserted into the compartment 122 may be inserted below or under any cards previously inserted and still disposed within that respective compartment 122. When the carousel 120 is rotationally positioned in the second of the card insertion rotational positions, however, any card inserted into the compartment 122 may be inserted above or over any cards previously inserted and still disposed within that respective compartment 122.

The path that is traveled by a card as it moves from the card infeed tray 12 to a compartment 122 of the carousel 120 is substantially straight and substantially horizontal. In this configuration, the distance traveled by the cards along the path is the shortest distance between the cards in the card infeed tray 12 and the compartment 122 of the carousel 120. The length of this path traveled by the cards may be minimized to minimize the length of the card handling device 10, and to maximize the speed by which cards may be delivered from the card infeed tray 12 to the carousel 120.

When the card handling device 10 is mounted on a gaming table such that the flat flange 30 (FIG. 1) is substantially flush with the upper gaming surface of the table, approximately the lower half of the carousel 120 may be located beneath the table surface. As a result, the card handling device 10 may have a relatively low profile on the table.

With continued reference to FIG. 4A, the card handling device 10 may further include a carousel drive system configured to selectively drive rotation of the carousel 120 about a shaft 121, by which the carousel 120 is rotatably mounted to the frame 21. The shaft 121 may be mounted to the frame 21 by means of threaded hand screws or a locking releasable mechanism, which may provide for easy removal and replacement of the carousel 120.

Figure 7:
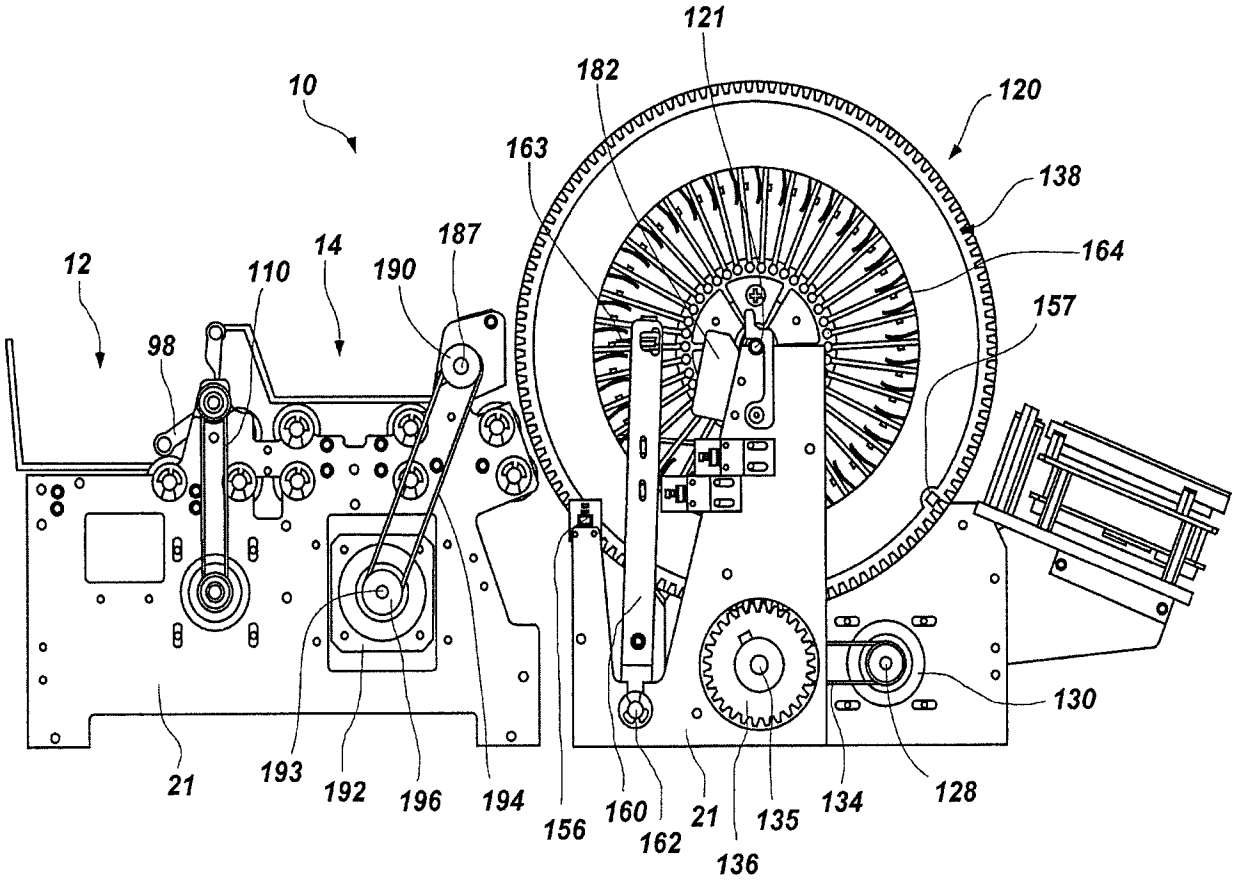
FIG. 7 is a view of a second, opposite side of the card handling device shown in FIG. 4A.

The carousel drive system may include, for example, a carousel drive motor 126 that is mounted to the frame 21, as shown in FIG. 4A. FIG. 7 is a view of a second, opposite side of the card handling device shown in FIG. 4A. By way of example and not limitation, a pulley 130 may be mounted to a drive shaft 128 of the carousel drive motor 126 (FIG. 4A), and another pulley (not shown) may be mounted to a driven shaft 135. An endless belt 134 may be provided around both the pulley 130 and the pulley (not visible in FIG. 7) mounted to the driven shaft 135. In this configuration, as the carousel drive motor 126 drives rotation of the drive shaft 128, the driven shaft 135 will also be rotationally driven by the carousel drive motor 126 and endless belt 134. A pinion gear 136 also may be mounted to the driven shaft 135. The pinion gear 136 may be sized, positioned, and otherwise configured to mesh with a toothed edge or surface 138 provided on the carousel 120. In this configuration, the carousel drive motor 126 may be used to selectively drive rotation of the carousel 120 about the shaft 121 in either the clockwise or counterclockwise direction.

In additional embodiments of the present invention, the carousel drive system may include any means for driving rotation of the carousel 120 including, for example, gears, sprockets, chains, belts, etc.

The carousel drive motor 126, which is used to selectively drive rotation of the carousel 120, also may be operatively controlled by a control system 220, which is described in further detail below.

Referring again to FIG. 4A, the card handling device 10 may further include a card output system 242 (FIG. 8) for moving cards out from the carousel 120 or other card storage device and into the card output tray 14. The card output system 242 (FIG. 8) may include, for example, an elongated swing arm 160 having a first end that is pivotally coupled to the frame 21 using a pin member 162. The elongated swing arm 160 may be configured to pivot about the pin member 162. The second end of the elongated swing arm 160 may be equipped or otherwise provided with a retractable inwardly projecting tab 163 (extending into the plane of FIG. 4A) that is configured to extend into a compartment 122 of the carousel 120 while the elongated swing arm 160 is swinging toward the card output tray 14 (see FIG. 1), but that retracts before and/or while the elongated swing arm 160 swings back to a resting position in which the elongated swing arm 160 is positioned near an inner circumference 164 of the compartments 122 of the carousel 120. In the extended position, the inwardly projecting tab 163 contacts any cards positioned within the aligned compartment 122 of the carousel 120. The inwardly projecting tab 163 of the elongated swing arm 160 retracts as it comes into contact with stationary tab 182 mounted to the frame 21.

Referring to FIG. 4B, the card handling device 10 may include a swing arm drive system, which may include a swing arm drive motor 166, an endless belt 168, a first idler pulley 170, and a second idler pulley 172. The first idler pulley 170 and the second idler pulley 172 may be mounted to the frame 21. The endless belt 168 may extend around a pulley 174 mounted to a drive shaft 176 of the swing arm drive motor 166, the first idler pulley 170, and the second idler pulley 172. The endless belt 168 is also securely attached to the swing arm 160 at a location between the first idler pulley 170 and the second idler pulley 172 using, for example, a clamp 178. In this configuration, the swing arm 160 may be selectively swung toward the card output tray 14 by selectively jogging the endless belt 168 around the pulleys 170, 172, 174 in the clockwise direction in FIG. 4B using the swing arm drive motor 166, and the swing arm 160 may be selectively swung away from the card output tray 14 by selectively jogging the endless belt 168 around the pulleys 170, 172, 174 in the counterclockwise direction in FIG. 4B using the swing arm drive motor 166.

The swing arm drive motor 166, which is used to selectively move the swing arm 160, also may be operatively controlled by the control system 220 subsequently described herein.

Referring to FIG. 4B, as the swing arm 160 is caused to swing toward the card output tray 14 and eject a card or cards out from a compartment 122 of the carousel 120, the card may be at least partially forced between a card output roller 186 and an opposing card output idler roller 188. The card output roller 186 may be mounted on a shaft 187. As shown in FIG. 7, a pulley 190 also may be mounted on the shaft 187, and a card output roller drive motor 192 that is attached to the frame 21 may be used to drive rotation of the shaft 187 using an endless belt 194. The endless belt 194 may extend around the pulley 190 mounted on the shaft 187 and another pulley 196 mounted on a drive shaft 193 of the card output roller drive motor 192. In some embodiments of the invention, intermeshing gears may be provided on both the shaft 187 of the card output roller 186 and a shaft 189 of the opposing card output idler roller 188 to ensure that the card output roller 186 and opposing card output idler roller 188 are driven in unison. In this configuration, the card output roller drive motor 192 may be caused to spin the card output roller 186 and opposing card output idler roller 188 as the swing arm 160 is caused to eject a card or cards out from a compartment 122 of the carousel 120 and force the card or cards between the card output roller 186 and the opposing card output idler roller 188. The rotation of the card output roller 186 and the opposing card output idler roller 188 may force and advance the card or cards therebetween into the card output tray 14, where the card or cards may be accessible to a dealer or other user of the card handling device 10. A sensor 200 (FIG. 4A) may be located and configured to sense or detect when no cards are present in the card output tray 14, and to convey such information to the control system 220 subsequently described herein.

As shown in FIG. 7, one or more sensors 156 may also be provided and configured to detect a relative position of the carousel 120 so as to enable the control system 220 (FIG. 8) subsequently described herein to identify which compartment 122 is aligned to receive a card from the card infeed system 240 and which compartment 122 is aligned for ejection of any cards therein by the card output system 242. By way of example and not limitation, the card handling device 10 may include one magnetic sensor 156 that is configured to detect a magnet 157 positioned on the carousel 120, as shown in FIG. 7. The position of the carousel 120 when the magnet 157 is positioned adjacent the magnetic sensor 156 may be designated as a "home" position of the carousel 120. The card handling device 10 may be configured to position the carousel 120 in the home position when the card handling device 10 is powered on. An encoder (not shown) that is associated with at least one of the carousel drive motor 126 or the carousel 120 itself then may be used to keep track of the rotational movement of the carousel 120 from the home position, and the information received from the encoder may be used by the control system 220 (FIG. 8) to identify the relative rotational position of the carousel 120 at any given time.

In the embodiment described above, the path each card travels as the card moves from a selected compartment 122 of the carousel 120 into the card output tray 14 (i.e., the card output path) is substantially horizontal and above the path each card travels as the card moves from the card infeed tray 12 to a selected compartment 122 of the carousel 120 (i.e., the card infeed path). In additional embodiments of the present invention, the card infeed path may be positioned vertically above the card output path. This vertical stacking or layering of the card infeed path and the card output path allows both the card infeed tray 12 and the card output tray 14 to be positioned on the same side of the card handling device 10 (relative to the carousel 120 or other card storage device). In yet additional embodiments, the card infeed path and the card output path may be disposed in substantially the same plane and laterally side-by-side one another.

Referring to FIGS. 4A and 4B, the card handling device 10 may further include a card sensing system that is configured to sense at least one identifying characteristic or feature of each card before the card is placed into a compartment 122 of the carousel 120 or other card storage device. By way of example and not limitation, the card sensing system may include a card sensor 210 that is configured to identify at least a rank (e.g., 2, 3, 4 . . . 10, jack, queen, king, ace) and suit (e.g., spade, club, diamond, heart) of a conventional playing card. The sensor 210 may be configured and positioned, for example, to detect the rank and suit of each card as the card passes between the previously described first drive system and second drive system of the card infeed system 240 (FIG. 8) (e.g., as the card passes between the second advancing roller 56 and the third advancing roller 72), as shown in FIGS. 4A and 4B.

By way of example and not limitation, the card sensing system may include a sensor 210 comprising, for example, a camera device that includes a complementary metal oxide semiconductor (CMOS) image sensor or a charge coupled device (CCD) image sensor. For example, the card sensing system may include a video camera imaging system as described (or substantially similar to that described) in U.S. patent application Ser. No. 10/623,223, filed Jul. 17, 2003 (which was published Apr. 8, 2004 as U.S. Patent Application Publication No. US2004/0067789 A1), now U.S. Pat. No. 7,677,565, issued Mar. 16, 2010, the disclosures of each of which are incorporated herein in their entirety by this reference. As described therein, one suitable card sensing system comprises the camera sold under the trademark "DRAGONFLY®" and available from Point Grey Research Inc. of Vancouver, British Columbia, Canada. The DRAGONFLY® camera includes a six-pin IEEE-1394 interface, an asynchronous trigger, and can be used to acquire images using multiple frame rates, to acquire 640×480 or 1024×724 24-bit true color images, or to acquire eight-bit grayscale images. Furthermore, the DRAGONFLY® camera is typically provided with image acquisition software and exhibits plug-and-play capability. Such a commercially available camera may be combined with commercially available symbol recognition software, which may be executed using an external computer (not shown). Such commercially available image recognition software may be "trained" to identify conventional playing card symbols and to classify and report each acquired image pattern as a specific card suit and rank. The graphics used to identify rank and suit of each card are not identical or standard and may vary between decks of cards. Once an image recognition software program for identifying rank and suit has been developed, the software program may be configured to allow the software program to be trained for each particular deck of cards to be handled by the card handling device 10 to enable the software program to accurately identify rank and suit of the particular cards used. Such training of the software program may be done at the casino table or by a security team before the card handling device 10 is placed on a table.

As yet another example, the sensor 210 may include a line scanning system or device that includes a contact image sensor (CIS) and associated field-programmable gate array (FPGA) device, as disclosed in U.S. patent application Ser. No. 11/152,475, filed Jun. 13, 2005, now U.S. Pat. No. 7,769,232, issued Aug. 3, 2010, and U.S. patent application Ser. No. 11/417,894, filed May 3, 2006, now U.S. Pat. No. 7,593,544, issued Sep. 22, 2009, the disclosures of each of which are hereby incorporated herein in their entirety by this reference. Such line scanning systems may require use of additional card position sensors. Sensors that may be used to identify a card position at the time a line scan is performed by the line scanning system are commercially available. Such line scanning systems may be small enough to be entirely incorporated into the card handling device 10 without requiring use of an external computer for executing an image recognition software program.

In some applications, the cards to be handled by the card handling device 10 may be standard unmarked conventional cards, and the sensor 210 may be configured to sense and identify only a conventional rank and suit of each card. In additional applications, the cards to be handled by the card handling device 10 may be marked with ultraviolet (UV), infrared (IR), near-infrared (near-IR), or visible wavelength inks or may have embedded radio frequency identification (RFID) tags, magnetic coding, bar codes, embedded electronic devices, or any other marking means, and the sensor 210 may be configured to detect at least one such marking in addition to, or instead of, identifying a rank and suit of each card. The card sensing system also may be configured to sense, detect, and identify cards that have been physically damaged (e.g., due to wear) and/or cards that have been marked in any way that facilitates cheating. The card sensing system may be configured to sense and identify cards that include one or more of cuts, abrasions, bends, dirt, and debris, and/or to verify that each card exhibits an expected, predefined color, thickness, reflectivity, mass, or other identifying characteristic or feature.

The card sensing system may be configured to communicate electrically with the subsequently described control system 220.

The card handling device 10 may further include a control system. The control system may configured to receive input signals from a user, to receive input signals from one or more of the various sensors described herein, and/or for selectively controlling one or more of the various previously described active components of the card handling device 10.

FIG. 8 is a schematic block diagram of one example of a control system 220 that may be used with the card handling device 10 shown in FIG. 1. In some embodiments, the entire control system 220 may be physically located within the card handling device 10. In other words, the control system 220 may be integrated into or with the outer cover 18 of the card handling device 10. In other embodiments, one or more components of the control system 220 may be physically located outside the card handling device 10. Such components may include, for example, a computer device (e.g., a desktop computer, a laptop computer, a handheld computer (e.g., personal data assistant (PDA)), a network server, etc.). Such external components may be configured to perform functions such as, for example, image processing, bonus system management, network communication, and the like.

As shown in FIG. 8, the control system 220 may include at least one electronic signal processor 222 (e.g., a microprocessor). The control system 220 also may include at least one memory device 224 for storing data to be read by the electronic signal processor 222 and/or for storing data sent to the at least one memory device 224 by the electronic signal processor 222. The control system 220 also may include one or more input devices 226 and one or more output devices 228. By way of example and not limitation, the one or more input devices 226 may include a keypad, a keyboard, a touchpad, a button, a switch, a lever, etc., and the one or more output devices 228 may include a graphical display device (i.e., a screen or monitor), a printer, one or more light-emitting diodes (LEDs), a device for emitting an audible signal, etc. In some embodiments of the present invention, the one or more input devices 226 and the one or more output devices 228 may be integrated into a single unitary structure.

For example, the control system 220 may include a display 34, as previously discussed herein, which may comprise a screen that can be used as both a touchpad that functions as an input device 226 and as a screen that functions as an output device 228 for displaying information about the card handling device 10 to a user, such as, for example, operating status of the card handling device 10. By way of example and not limitation, the display 34 may comprise a commercially available display sold by Reach Technology Inc., of Fremont, Calif., as part number 42-0092-03.

The touch screen display 34 may be located below the gaming table surface when the card handling device 10 is mounted to a gaming table in the manner previously described herein. The display 34 may be used to output information to a dealer or other user regarding information such as the identity of the cards that have been dealt into each hand, which may allow the dealer to assess whether the cards shown or played by that player are different (indicating that the cards have been changed or swapped) without alerting the player. For example, if a deviation between a dealt hand and a displayed or played hand were to occur, indicating a confirmed case of card switching, the dealer would be able to notify security without the player's knowledge, which may allow the cheating player to be apprehended. By providing or locating the display 34 below the surface of the table and/or facing away from the players at the table, the display 34 may be concealed from the players, and important information may be conveyed to and from casino personnel without the knowledge of the players. Touch screen controls on the display 34 also may provide a larger number of input options for the user, as compared to more standard push button controls. The display 34 may be capable of displaying alphanumeric information, graphical information, animation, video feed, and the like. In some embodiments of the present invention, a diagram of the card path and an indication of a location of a card jam may be displayed on the display 34 when a card jam occurs.

As shown in FIG. 8, the control system 220 may be configured to communicate electrically with each of the previously described card infeed system 240, the card output system 242, the temporary card storage system 244 or device, and the card sensing system 246. In this configuration, the control system 220 may be configured to receive input signals from a dealer or other user, signals from the various sensors of the card handling device 10, and to coordinate and control operation of the card infeed system 240, the card output system 242, the temporary card storage system 244, and the card sensing system 246 so as to perform various card handling operations, such as, for example, shuffling of cards placed in the card infeed tray 12, sorting of cards placed in the card infeed tray 12, and/or forming and sequentially dispensing playing hands from cards placed in the card infeed tray 12. Such operations are described in further detail below.

As shown in FIG. 8, in some embodiments of the present invention, the card sensing system 246 may include a separate controller 212 (e.g., a separate electronic signal processor, such as, for example, a field-programmable gate array (FPGA) device) for receiving signals from the sensor 210 (e.g., camera device or line scanning device) to determine rank and/or suit of each card being read or sensed by the card sensing system 246. In additional embodiments, such functions may be performed by the electronic signal processor 222 of the control system 220, or the controller 212 may be a separate controller that is integrated with the control system 220 and located remote from the sensor 210. In yet additional embodiments, the control system 220 may include any number of interconnected electronic signal processors and memory devices.

The control system 220 of the card handling device 10 may be configured under control of a computer program to enable a dealer or other user of the card handling device 10 to perform any one of a number of functions or operations on a deck of cards using the card handling device 10. The display 34 (or other input device) of the card handling device 10 may include a menu that allows the dealer or other user to select what function or operations the card handling device 10 is to perform on a deck of cards placed in the card infeed tray 12. The functions or operations may include one or more of shuffling operations, sorting operations, and dealing operations, as described in further detail below.

By way of example and not limitation, one function or operation that may be performed by the card handling device 10 is a shuffling operation that includes a deck shuffle with an entire shuffled deck output to the card output tray 14. In other words, the control system 220 of the card handling device 10 may be configured under control of a program to cause the card handling device 10 to randomly shuffle an entire deck of cards placed in the card infeed tray 12, and to dispense the entire deck of shuffled cards into the card output tray 14.

By way of example and not limitation, to shuffle a deck of cards placed in the card infeed tray 12, the control system 220 of the card handling device 10 may be configured to read or sense one or more identifying characteristics or features of each card as the card is carried past the card sensing system 246, as previously described herein, and to rotate the carousel 120 in a stepwise manner to insert the cards sequentially into each next adjacent compartment 122 of the carousel 120. The control system 220 may be configured to record information regarding the identity of each card and the particular compartment 122 of the carousel 120 into which each respective card is inserted. After all the cards have been placed into compartments 122 of the carousel 120, the control system 220 may cause the carousel 120 to spin or rotate so as to align the compartments 122 of the carousel 120 with the card output system 242 and to eject cards out from the compartments 122 of the carousel 120 in a random sequence. In other words, the cards may be placed in a randomized or shuffled sequence as they are removed from the carousel 120. In this manner, the cards or groups of cards may be provided in the card output tray 14 in a random, shuffled sequence.

As another example of a manner in which the card handling device 10 may be used to shuffle cards placed in the card infeed tray 12, the control system 220 of the card handling device 10 may be configured to read or sense one or more identifying characteristics or features of each card as the card is carried past the card sensing system 246, as previously described herein, and to randomly rotate the carousel 120 to insert the cards sequentially into next adjacent compartments 122 of the carousel 120. After all the cards have been randomly placed into compartments 122 of the carousel 120, the control system 220 may cause the carousel 120 to spin or rotate in a step-wise sequential motion as the card output system 242 ejects cards out from the compartments 122 of the carousel 120. In other words, the cards may be placed in a randomized or shuffled sequence as they are placed into the carousel 120. In this additional manner, the cards or groups of cards may be provided in the card output tray 14 in a random, shuffled sequence.

In yet additional embodiments, the cards may be randomized or shuffled both while they are placed in the carousel 120 and as they are removed from the carousel 120.

Another function or operation that may be performed by the card handling device 10 is a sorting operation that includes a deck sort with an entire sorted deck output to the card output tray 14. In other words, the control system 220 of the card handling device 10 may be configured under control of a program to cause the card handling device 10 to sort an entire deck of cards placed in the card infeed tray 12 into a predefined order, and to dispense all or part of the entire deck of sorted cards into the card output tray 14. By way of example and not limitation, the predefined order may include a so-called "new deck order," or "pack order," which typically includes each of the four suits in the order of spades, diamonds, clubs, and hearts, each suit arranged in the order of 2, 3, 4, . . . 10, jack, queen, king, ace, followed by jokers, if they are included.

By way of example and not limitation, to order or sort a deck of cards placed in the card infeed tray 12, the control system 220 of the card handling device 10 may be configured to read or sense one or more identifying characteristics or features of each card as the card is carried past the card sensing system 246, as previously described herein. The control system 220 may be configured to assign a compartment 122 to each of the cards, and to rotate the carousel 120 to align each respective compartment 122 with the card infeed system 240 (FIG. 8) when the card assigned to the respective compartment 122 is positioned to be inserted into the carousel 120 by the card infeed system 240. In one example, two cards may be assigned to each compartment 122 of the carousel 120 so that the order of cards delivered is completely controlled. This ordering is possible because the design of the carousel 120 allows the second card to be inserted above or below the first inserted card, as previously described herein. In this manner, the cards are placed or positioned within the carousel 120 in a predefined manner or pattern. After the cards have been placed into the compartments 122 of the carousel 120, the control system 220 may cause the carousel 120 to spin or rotate as necessary to eject the cards out from the carousel 120 and move the cards to the card output tray 14 in the predefined sorted or ordered sequence. Cards may be unloaded sequentially, or according to another assigned order. In other words, the cards may be placed in a predefined arrangement within the carousel 120 and removed from the carousel 120 in a manner that provides the predefined final ordered or sorted sequence. In this manner, the cards may be provided in the card output tray 14 in a sorted or ordered sequence.

As another example of a manner in which the card handling device 10 may be used to order or sort a deck of cards placed in the card infeed tray 12, the control system 220 of the card handling device 10 may be configured to read or sense one or more identifying characteristics or features of each card as the card is carried past the card sensing system 246, as previously described herein, and to randomly insert the cards into the carousel 120 while recording the identity and location of each card in the carousel 120. After all the cards have been placed into compartments 122 of the carousel 120, the control system 220 may cause the carousel 120 to spin or rotate as necessary as the card output system 242 ejects cards out from the compartments 122 of the carousel 120 such that the cards are ejected in an ordered or sorted sequence. In other words, the cards may be placed in an ordered or sorted sequence as they are ejected or otherwise removed from the carousel 120. In this additional manner, the cards may be provided in the card output tray 14 in a sorted or ordered sequence. In such methods of ordering or sorting a deck of cards, the carousel 120 may be configured to include enough compartments 122 to allow a single card to be inserted into each compartment 122.

Yet another function or operation that may be performed by the card handling device 10 is a dealing operation that includes a sequential output of randomly generated playing hands (or other subsets of cards) to the card output tray 14, each hand or subset of cards comprising a predetermined number of cards. In other words, the control system 220 of the card handling device 10 may be configured under control of a program to cause the card handling device 10 to dispense a first randomly generated playing hand or subset into the card output tray 14. A second randomly generated playing hand may not be output to the card output tray 14 until the control system 220 receives a signal from the sensor 200 (FIG. 4A) indicating that the first randomly generated playing hand has been removed from the card output tray 14. This process may continue until a selected number of randomly generated playing hands has been dispensed and removed from the card output tray 14. If the game being played requires other sets of playing cards, such as, for example, a set of flop cards, common cards, extra player cards, etc., such sets of cards also may be generated and dispensed into the card output tray 14 in the sequential manner described above to prevent the sets of cards from being mixed with other playing hands or sets of cards. After the last playing hand or set is delivered, any cards from the deck or decks that remain in compartments 122 of the carousel 120 may be automatically unloaded to the card output tray 14, or the remaining cards may be unloaded to the card output tray 14 upon receiving an input signal from the dealer or other user (for example, an input signal generated by touching a predefined button on the touchpad display 34).

In some embodiments of the present invention, the control system 220 (FIG. 8) of the card handling device 10 may be programmed to handle a particular deck of cards, such as, for example, a conventional deck of 52 playing cards comprising suits of spades, clubs, diamonds, and hearts, each suit comprising cards ranking 2, 3, 4 . . . 10, jack, queen, king, and ace. By way of example and not limitation, when such a deck of cards is placed into and detected within the card infeed tray 12 of the card handling device 10, the control system 220 (FIG. 8) may be configured under control of a program to electronically generate a random or shuffled sequence of the deck, and to identify the playing hands (or other subsets of playing cards) that would be generated and dealt if the electronically shuffled deck of cards were actually physically dealt to the players (and the dealer himself) by the dealer. The control system 220 then may assign one compartment 122 of the carousel 120 to each of those hands or subsets of playing cards, which may be referred to as "hand compartments." Then, as the cards are fed into the card handling device 10 and identified by the card sensing system 246, the control system 220 may cause the carousel 120 to selectively rotate such that any cards corresponding to the hands or subsets of cards are placed within the corresponding hand compartments 122 of the carousel 120. Other cards not corresponding to hands or subsets of cards may be placed in one or more of the other compartments 122 of the carousel 120 not designated as hand compartments 122. The control system 220 then may cause the card output system 242 (FIG. 8) to dispense a first hand or subset of cards within the first hand compartment 122 into the card output tray 14. After the dealer has removed the first hand or subset of cards from the card output tray 14 and given that hand or subset of cards to the corresponding first player, the control system 220 then may cause the card output system 242 to dispense a second hand or subset of cards within the second hand compartment 122 into the card output tray 14. This process may continue until a selected number of randomly generated playing hands has been dispensed and removed from the card output tray 14 and dealt to the table.

An additional function or operation that may be performed by the card handling device 10 is a dealing operation that includes sequential dispersing of sorted, predefined playing hands or subsets of cards to the card output tray 14. In other words, the control system 220 of the card handling device 10 may be configured under control of a program to cause the card handling device 10 to generate and dispense a first predefined and/or sorted playing hand or set of cards to the card output tray 14. Once the control system 220 receives a signal from the sensor 200 (FIG. 4A) indicating that the first predefined and/or sorted playing hand or set of cards has been removed from the card output tray 14, a second predefined and/or sorted playing hand or set of cards may be output to the card output tray 14. This process may be continued until a selected number of predefined and/or sorted playing hands or sets of cards has been sequentially dispensed and removed from the card output tray 14. This function or operation may be useful in games or situations in which it is necessary or desired to begin with predefined hands or sets of playing cards. After the last playing hand or set is delivered, any cards from the deck or decks that remain in compartments 122 of the carousel 120 may be automatically unloaded to the card output tray 14, or the remaining cards may be unloaded to the card output tray 14 upon receiving an input signal from the dealer or other user (for example, an input signal generated by touching a predefined button on the touchpad display 34).

The card handling device 10 also may be configured to be programmable by an end user. The computer software of the control system 220 may include a programming module that allows an end user to enter a name for a new game, and to select how the card handling device 10 will dispense cards into the card output tray 14 in a manner that facilitates the formation of hands or other sets of cards for playing that particular new game (i.e., the end user may be able to define an additional function or operation or sequence of functions or operations to be performed by the card handling device 10).

For example, the display 34 may include a touch screen or other user controls that may be used to program the control system 220 of the card handling device 10. For example, the card handling device 10 may be programmed to sequentially deliver a specified number of hands each comprising a specified number of players. Furthermore, the card handling device 10 may be programmed to deliver a specified number of cards to a dealer, a specified number of flop cards, a bonus hand, common cards, or any other card or cards used in the play of a casino card game. The touch screen or other user controls of the display 34 also may be used to input a name of a game for which the card handling device 10 has been programmed, so that the name of the programmed game appears on the display 34 in a menu of user selectable games. By employing a control system 220 that is programmable by an end user as described herein, the need for factory programming or re-programming of the card handling device 10 every time a new casino card game is developed may be eliminated, which may save time, eliminate the need for re-submission of software to various gaming agencies for approval before implementation in a casino, and eliminate the need for upgrading software in the field.

By way of example and not limitation, the card handling device 10 may be programmed by an end user to deliver cards in a pattern or sequence corresponding to the game of THREE CARD POKER®, which requires that the players and dealer each receive three cards. If a new game that utilizes three player cards (each) and three dealer cards were to be developed in the future, an end user would be able to input information including the new game name into the card handling device 10 and the card handling device 10 would be configured for playing such a game without requiring a software change.

Card handling devices that embody teachings of the present invention, such as the card handling device 10 shown in FIG. 1, may be incorporated into a table game management system by connecting or otherwise providing communication between the control system 220 of the card handling device 10 and a network 250. For example, a data port (not shown) on the card handling device 10 may be used to provide electrical communication to the network 250 through a conductive wire or cable. As shown in FIG. 8, the network 250 may communicate with the electronic signal processor 222 of the control system 220. In additional embodiments, the network 250 may communicate directly with a controller 212 (which may include an additional electronic signal processor) of the card sensing system 246, or with both the electronic signal processor 222 of the control system 220 and the controller 212 of the card sensing system 246.

In additional embodiments, the card handling device 10 may include a device configured to communicate wirelessly with the network 250 (e.g., using signals carried by electromagnetic radiation). The network 250 may comprise one or more remote computer devices (i.e., computer workstations and/or servers), and the network 250 may be a local table network or a casino network.

As described above, the card sensing system 246 (FIG. 8) of the card handling device 10 may be used to recognize the presence of cards, to count cards, and to identify each card (e.g., identify the rank and suit of each card). As each card is passed from the card infeed tray 12 into a compartment 122 of the carousel 120, the completeness of the deck also may be verified. In the event a card is missing or an extra card is present, a warning signal (which may be displayed on the display 34) or other alarm may be communicated over the network 250 to a remote location (e.g., another computer or server) for informing management of the situation.

The network 250 also may be used to collect and/or process data from other data collection devices on a gaming table such as, for example, radio frequency identification (RFID) wager amount sensors, object sensors, chip tray inventory sensors, and the like. Data may be collected on the table and sent to a remote database for later analysis and processing, or the data may be analyzed in real-time.

One aspect of the present invention is to provide a card handling device capable of dispensing bonus or promotional cards used to provide a prize, incentive or compensation to a player.

In some embodiments of the present invention, a number of compartments 122 may be pre-assigned to receive bonus or promotional cards. Such cards may be manually inserted by first removing the cover 18 (FIG. 1), may be inserted through a secure opening (not shown) in the cover 18 or may be inserted through the same card infeed tray 12 used to insert the regular playing cards. Furthermore, bonus or promotional cards may be fed into the card handling device 10 before or after the playing cards are inserted into the card handling device 10, or they may be intermixed with the playing cards, detected by the card sensing system 246 (FIG. 8), and diverted to a designated compartment 122 of the carousel 120 by the control system 220 (FIG. 8).

The control system 220 of the card handling device 10 may be configured under control of a computer program to insert bonus or promotional cards into one or more preselected compartments 122 of the carousel 120. Bonus or promotional cards may be dispensed to a recipient player in response to events such as a) a jackpot reaching a predetermined amount, b) according to a preselected date and time, c) randomly, d) in response to a game event such as receiving a royal flush in a poker game, e) when a player loyalty account reaches a certain balance, f) in response to a signal to the control system 220 by a remote computer system to dispense a card, or by any other means. Any card game player can receive a bonus card, regardless of the type of game. For example, a casino might link together 80 live tables, including blackjack, baccarat, THREE CARD POKER® and other games.

The dispensing of bonus or promotional cards to players can occur more or less frequently. As an example, a casino may wish to run a "free buffet" promotion for THREE CARD POKER® players during the dinner hour on Saturday nights. The device may be programmed to dispense a bonus card entitling the player recipient to two buffet passes when the player obtains a three of a kind hand. As another example, a casino may want to give away a vehicle based on a random bonus event. In such a scenario, a bonusing system may be maintained and controlled on a server or computer that is in communication with all card handling devices 10 through a common network (e.g., all card handling devices 10 in a casino or an area of a casino). When the random bonus event occurs, the bonusing system may send only one signal to a single selected card handling device 10 on the network to cause that selected card handling device 10 to dispense a bonus card. The selected card handling device 10 may be randomly selected or may be selected according to a schedule.

The presence of the previously described gate member 98 in the card infeed tray 12 may allow a casino operator or other person to load a designated number of bonus cards from the card infeed tray 12, either before or after loading regular playing cards, without interrupting game play. In some embodiments, the control system 220 may be configured under control of a computer program to cause the display 34 to indicate when the card handling device 10 is out of bonus or promotional cards. Bonus or promotional cards may be provided with an identifying characteristic or feature (such as a specific marking or color) that may be detected by the card sensing system 246 to allow the control system 220 to keep track of the number and location of bonus or promotional cards contained in the machine at any given time.

Card handling devices that embody teachings of the present invention may be capable of performing a variety of additional functions other than those previously described herein. For example, the card handling device 10 shown in FIG. 1 may be configured to access a wireless or wired communication network 250 (FIG. 8) and to communicate information relating to maintenance, repair, machine serial number, current or past operation, performance or usage to a remote location for access and/or analysis by a casino operator, maintenance personnel, a person or entity supplying card handling devices to a casino, etc.

The card handling device 10 shown in FIG. 1 also may be programmed to operate in multiple modes (i.e., a set-up mode, a run mode, a shuffle mode, a sort mode, a random hand forming mode, a pre-ordered hand forming mode, a deck order mode, a service mode, etc.) and to switch between modes without powering down. The control system 220 of the card handling device 10 also may be configured under control of a computer program to run a self-diagnosis either when the card handling device 10 is in a service mode and a user inputs a request for a self-diagnosis, or when a single card is fed into the card handling device 10, and to create a report of the function of all operational elements of the card handling device 10. This information may be sent to an output device 228 (FIG. 8) such as, for example, a printer attached to the card handling device 10 or incorporated into the card handling device 10.

Card handling devices that embody teachings of the present invention, such as the card handling device 10 shown in FIG. 1, also may be configured to collect and store data or information regarding, for example, card composition, hand composition, rounds played, hands played, cards dealt, or cards delivered to the carousel 120, and to deliver such data or information to a remote computer or output device through a network 250 (FIG. 8) or to store the data or information in a memory device (e.g., the memory device 224 (FIG. 8)) for subsequent retrieval and analysis. Card handling devices that embody teachings of the present invention also may be configured to collect information regarding the current operating status of the card handling devices, such as, for example, whether the card handling devices are activated (e.g., powered on), deactivated (e.g., powered off), operating correctly, or in an error mode. Such status information also may be delivered to a remote computer or output device through a network 250 (FIG. 8) or stored in a memory device (e.g., the memory device 224 (FIG. 8)) for subsequent retrieval and analysis.

Figure 9:
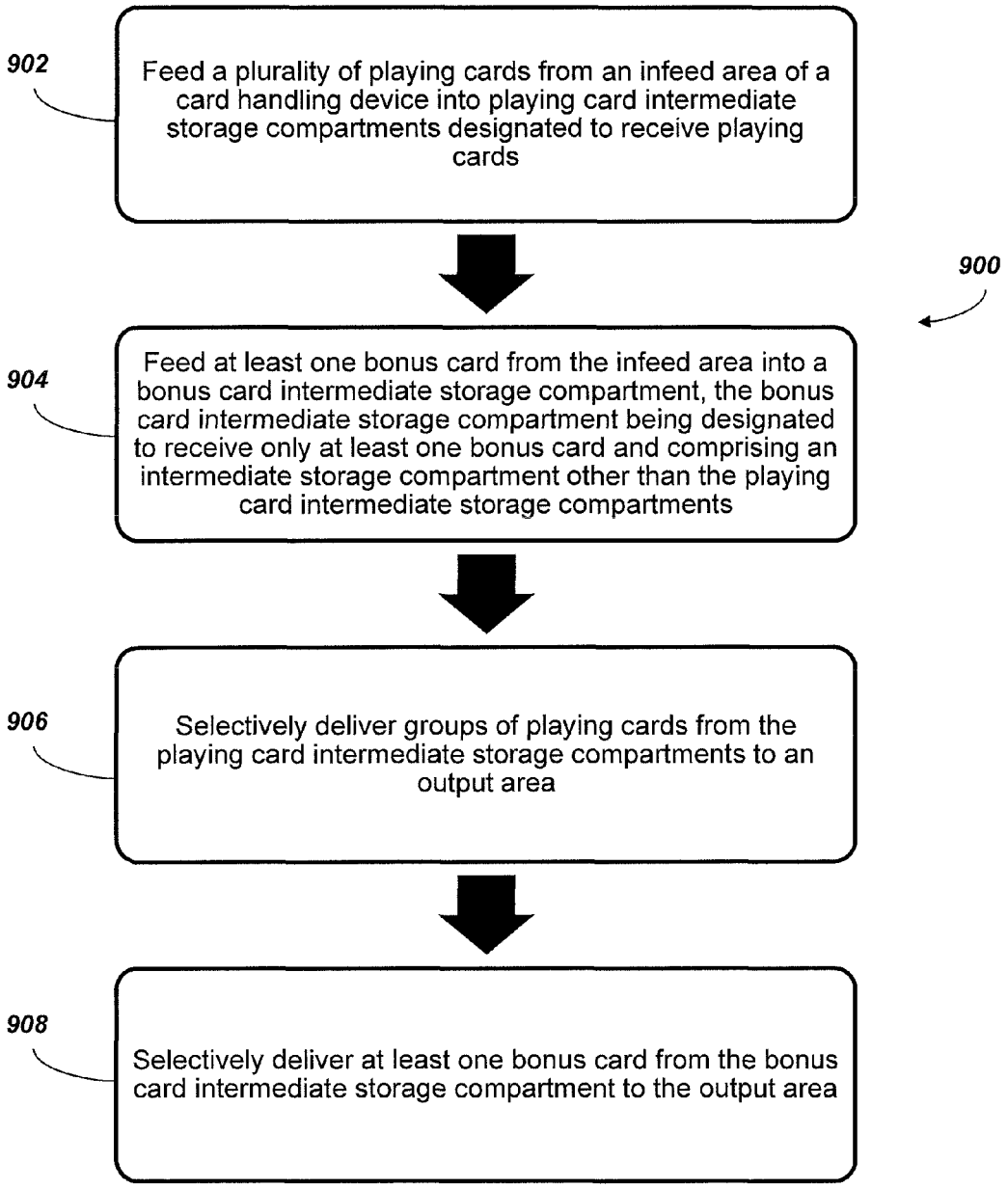
FIG. 9 is a flow chart showing acts in a method of using a card handling device.

Referring to FIG. 9, a method 900 of using a card handling device may include delivering groups of playing cards to card games and delivering at least one bonus card. More specifically, a plurality of playing card may be fed from an infeed area of a card handling device into playing card intermediate storage compartments designated to receive playing cards, as indicated at 902. At least one bounce card may be fed from the infeed area into a bonus card intermediate storage compartment, the bonus card intermediate storage compartment being designated to receive only at least one bonus card and comprising an intermediate storage compartment other than the playing card intermediate storage compartments, as indicated at 904. Groups of playing cards may be selectively delivered from the playing card intermediate storage compartments to an output area, as indicated at 906. At least one bonus card may be selectively delivered from the bonus card intermediate storage compartment to the output area, as indicated at 908.

The above examples of embodiments of the present invention are meant to be non-limiting. Many other embodiments of the invention are contemplated. For example, a card handling system of a card handling device that embodies teachings of the present invention may be configured to perform a verification of a deck of cards without rearranging an order in which the cards are inserted into the card handling machine. Such a verification may be used to verify that a certain number of cards are present in the set (i.e., that the deck is a complete deck), and that the cards in the deck are in acceptable playing condition. As another example, a card handling system of a card handling device that embodies teachings of the present invention may be configured to decommission cards when cards having an unacceptable amount of wear or damage are detected. Furthermore, additional card sensing systems and schemes may be used in place of the disclosed sensing systems. Card handling devices that embody teachings of the present invention may not include a separate card infeed tray and card output tray, and may include a single tray in which cards are placed to feed the cards into the machines and into which the cards are dispensed after being handled by the card handling devices. Furthermore, many different arrangements of data collection and analysis hardware and software may be used in connection with card handling devices that embody teachings of the present invention to obtain information relating to player performance and win/loss information on a casino game.

Generally, unless specifically otherwise disclosed or taught, the materials for making the various components of the present invention may be selected from appropriate materials, such as plastics, metal, metallic alloys, ceramics, fiberglass, elastomers, composites, and the like. Many components of the system are conventional, commercially available components unless otherwise indicated, including motors, belts, pulleys, rotational shafts, rollers, sprockets, gears, pinions, pulleys, cams, support structures, and the like. The electrical components may include conventional circuitry, wires, fuses, soldered connections, chips, switches, boards, microprocessors, stepper motors, computers, and control system components.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventors.

What is claimed is:

1. A card handling device, comprising:

a card handling zone;

a card infeed tray configured to receive cards to be moved into the card handling zone and a separate a card output tray configured to receive cards moved from the card handling zone, a plane defined by an opening to the card output tray being at least substantially coplanar with another plane defined by an opening to the card infeed tray, the card infeed tray and the card output tray located adjacent one another on a common side of the card handling zone;

a user input for receiving an input instruction from a user;

a card sensing system configured to identify at least one feature or characteristic of each card handled by the card handling device; and a control system comprising:

at least one electronic signal processor;

at least one memory device in electrical communication with the at least one electronic signal processor; and a computer program stored in memory of the at least one memory device, the computer program programmed to cause the control system to selectively control at least one of a card infeed system, the card handling zone, and a card output system of the card handling device and to receive an input from the user input to selectively perform at least one of a shuffling operation, a sorting operation, and a dealing operation using the card handling device.

2. The card handling device of claim 1, wherein the user input comprises at least one of a button, a keypad, a keyboard, a touchpad, a switch, and a lever.

3. The card handling device of claim 1, wherein the control system is in communication with at least one output device.

4. The card handling device of claim 3, wherein the at least one output device comprises at least one of a graphical display device, a printer, a light emitting diode (LED), and an audio signal emitter.

5. The card handling device of claim 1, wherein the computer program is further programmed to cause the control system to generate at least two playing hands or subsets of cards from a set of cards placed in the card infeed tray and to sequentially dispense each playing hand or subset of cards of the at least two playing hands or subsets of cards into the card output tray.

6. The card handling device of claim 5, wherein the computer program is further programmed to cause the control system to randomly generate each playing hand or subset of cards of the at least two playing hands or subsets of cards from the set of cards.

7. The card handling device of claim 5, wherein the computer program is further programmed to cause the control system to dispense a first playing hand or subset of cards of the at least two playing hands or subsets of cards into the card output tray and to automatically dispense a second playing hand or subset of cards of the at least two playing hands or subsets of cards into the card output tray after the first hand or subset of cards is removed from the card output tray.

8. The card handling device of claim 1, further comprising:

a card storage system in the card handling zone comprising a plurality of compartments configured to receive cards therein;

a card infeed system configured to move cards from the card infeed tray to the card storage system; and a card output system configured to move cards from the card storage system to the card output tray.

9. The card handling device of claim 8, wherein the card storage system comprises a carousel and a carousel drive motor configured to drive rotation of the carousel.

10. A card handling device, comprising:

a card handling zone;

a card infeed tray configured to receive cards to be moved into the card handling zone and a card output tray configured to receive cards moved from the card handling zone, a plane defined by an opening to the card infeed tray and another plane defined by an opening to the card output tray being coplanar, the card infeed tray and the card output tray being located adjacent one another on a common side of the card handling zone;

a user input device;

a card sensing system configured to identify at least one feature or characteristic of each card handled by the card handling device; and a control system configured to selectively control at least one of a card infeed system, the card handling zone, and a card output system of the card handling device, to receive at least one signal from the card sensing system, and when performing a shuffling operation, to cause the card handling device to automatically dispense a first playing hand or subset of cards into the card output tray and to at least substantially automatically dispense at least a second playing hand or subset of cards into the card output tray after the first playing hand or subset of cards is removed from the card output tray in response to a signal indicating the card output tray is empty, and to cause the card handling device to selectively perform at least one of a shuffling operation and a sorting operation in response to a second input signal indicating a shuffling or a sorting operation from the user input device.

11. The card handling device of claim 10, further comprising:

a card storage system within the card handling zone comprising a plurality of compartments configured to receive cards therein;

a card infeed system configured to move cards from the card infeed tray to the card storage system; and a card output system configured to move cards from the card storage system to the card output tray.

12. The card handling device of claim 11, wherein the card storage system comprises a carousel and a carousel drive motor configured to drive rotation of the carousel.

13. A method of forming hands or subsets of cards from a set of cards for use in a card game, the method comprising:

receiving a set of cards in a card infeed tray on a first side of a card handling device;

automatically moving cards of the set of cards from the card infeed tray to a card handling zone of the card handling device located on a second, opposing side of the card handling device;

at least substantially automatically generating a randomly ordered first hand or subset of cards from the set of cards and dispensing the first hand or subset of cards to a card output tray located on the first side of the card handling device adjacent the card infeed tray, the card output tray having a plane defined by an opening to the card output tray being coplanar with another plane defined by an opening to the card infeed tray, wherein at least substantially automatically generating the first hand or subset of cards comprises:

identifying cards moving from the card infeed tray into the card handling zone using a card sensing system;

using a control system of the card handling device to form the first hand or subset of cards; and moving the first hand or subset of cards from the card handling zone to the card output tray; and at least substantially automatically forming at least a second randomly ordered hand or subset of cards from the set of cards in response to a signal indicating the card output tray is empty and moving the at least a second hand or subset of cards to the card output tray of the card handling device.

14. The method of claim 13, wherein receiving the set of cards in the card infeed tray comprises receiving a standard deck of playing cards in the card infeed tray.

15. The method of claim 13, wherein at least substantially automatically generating the first hand or subset of cards from the first set of cards comprises at least substantially automatically generating a predetermined first hand or subset of cards from the set of cards.

16. The method of claim 13, wherein at least substantially automatically generating the first hand or subset of cards from the first set of cards comprises automatically generating the first hand or subset of cards after receiving an input signal from a user input device.

17. A card handling device, comprising:

a card handling zone;

a card infeed tray configured to receive cards to be moved into the card handling zone and a card output tray configured to receive cards moved from the card handling zone, wherein the card infeed tray and the card output tray are located adjacent one another on a common side of the card handling zone and wherein a plane defined by an opening of the card infeed tray and a plane defined by an opening of the card output tray are coplanar;

a card infeed system configured to move cards from the card infeed tray to the card handling zone;

a card output system configured to move cards from the card handling zone to the card output tray;

a card sensing system configured to identify at least one feature or characteristic of each card handled by the card handling device; and a control system comprising:

at least one electronic signal processor;

at least one user input device;

at least one output device;

at least one memory device in electrical communication with the at least one electronic signal processor; and a computer program stored in the at least one memory device, the computer program being programmed to cause the control system to selectively control at least one of the card infeed system, the card handling zone, and the card output system, to receive at least one signal from the card sensing system, and to receive at least one signal from the at least one user input device to selectively perform at least one of a shuffling operation and a sorting operation.

18. The card handling device of claim 17, wherein the at least one user input device comprises at least one of a button, a keypad, a keyboard, a touchpad, a switch, and a lever.

19. A card handling device, comprising:

a card infeed tray located on a first side of the card handling device, the card infeed tray comprising a first plane defined by an opening to the card infeed tray;

a card handling zone located on a second, opposing side of the card handling device;

a card infeed system configured to remove cards from the card infeed tray and into the card handling zone;

a card output tray located on the first side of the card handling device adjacent the card infeed tray, the card output tray comprising a second plane defined by an opening to the card output tray, the first plane being at least substantially coplanar with the second plane;

a card output system configured to deliver cards from the card handling zone to the card output tray;

a user input device;

a card sensing system configured to identify at least one feature or characteristic of each card handled by the card handling device; and a control system comprising:

at least one electronic signal processor;

at least one memory device in electrical communication with the at least one electronic signal processor; and a computer program stored in memory of the at least one memory device, the computer program being programmed to case the control system to selectively control at least one of the card infeed system, the card handling zone, and the card output system, to receive at least one signal from the card sensing system, and to receive a signal from the user input device to selectively perform at least one of a shuffling operation, a sorting operation, and a dealing operation.

20. The card handling device of claim 19, wherein the user input device comprises at least one of a button, a keypad, a keyboard, a touchpad, a switch, and a lever.

* * * * *